US005865191A

United States Patent [19]

Kimeta

[11] Patent Number: 5,865,191

[45] Date of Patent: Feb. 2, 1999

[54] HAIR LIFTING METHOD HAIR LIFTING COMB AND COLLAPSIBLE HAIR LIFTING COMB

[76] Inventor: Yuji Kimeta, 11-3-505, 2-chome, Meguro, Meguro-Ku, Tokyo, Japan, 153

[21] Appl. No.: 877,704

[22] Filed: Jun. 17, 1997

[30] Foreign Application Priority Data

| | | | |
|---|---|---|---|
| Jun. 17, 1996 | [JP] | Japan | 8-007015 U |
| Aug. 12, 1996 | [JP] | Japan | 8-008699 U |
| Sep. 12, 1996 | [JP] | Japan | 8-010535 U |
| Nov. 12, 1996 | [JP] | Japan | 8-300366 |
| Dec. 17, 1996 | [JP] | Japan | 8-013884 U |
| Dec. 26, 1996 | [JP] | Japan | 8-349096 |
| Mar. 4, 1997 | [JP] | Japan | 9-049457 |

[51] Int. Cl.[6] ..... A45D 7/00

[52] U.S. Cl. ..... 132/210; 132/213.1; 132/139; 132/161

[58] Field of Search ..... 132/210, 213, 132/213.1, 214, 161, 126, 127, 131, 137, 139, 142, 144, 148, 124

[56] References Cited

U.S. PATENT DOCUMENTS

| | | | |
|---|---|---|---|
| 2,029,792 | 2/1936 | Pluchino | 132/214 |
| 2,449,430 | 9/1948 | Voight | 132/139 |
| 2,678,047 | 5/1954 | Garfield | 132/213 |
| 2,858,835 | 11/1958 | Parziale | 132/213.1 |
| 2,883,994 | 4/1959 | Angelini et al. | 132/139 |
| 3,125,101 | 3/1964 | Clark | 132/161 |
| 5,704,376 | 1/1998 | Ogunro | 132/139 |

FOREIGN PATENT DOCUMENTS

| | | | |
|---|---|---|---|
| 615970 | 1/1949 | United Kingdom | 132/140 |

*Primary Examiner*—Gene Mancene
*Assistant Examiner*—Pedro Philogene
*Attorney, Agent, or Firm*—Jacobson, Price, Holman & Stern, PLLC

[57] ABSTRACT

According to a hair lifting comb of the present invention, a plurality of teeth, which are as thick as a bar-shaped supporting member and which at their distal ends are shaped like birds' beaks, are attached to the supporting member, as are side members of the comb, each of which is constituted by a first frame member, a second frame member and a third frame member. The thus structured comb, which maintains the supporting member at a maximum height of 18 mm from the scalp, is inserted into hair at the hairline and moved toward the rear of the head to lift the hair to a predetermined height.

16 Claims, 19 Drawing Sheets

1

1

2

HAIR LIFTING METHOD HAIR LIFTING COMB AND COLLAPSIBLE HAIR LIFTING COMB

BACKGROUND OF THE INVENTION

1. Field of the Invention

The present invention relates to a hair lifting method, and a hair lifting comb and a collapsible hair lifting comb.

2. Related Arts

Currently popular among women are upsweep, full hair styles; particularly popular is a hair style for which the hair is lifted up from its roots along the hairline on the sides of the head.

To arrange the hair for this style, the hair is lifted with a comb or a brush, which is held in one hand, while a hair dryer, which is held in the other hand, is used to blow warm air onto the hair. Thereafter, for fixing, a hair spray is applied to the hair.

With the conventional hair lifting method, however, a great deal of time and effort is required to use a comb or a brush to arrange the hair, and to then fix the hair style. For these reasons, lifting the hair is not easy.

Furthermore, as most combs are originally intended to be used to prevent hair from rising, generally the teeth of combs are thin. There are combs that have thick teeth, however, including the hemispherical ornamental hair combs used for Japanese hair styles, boxwood combs, dandruff combs, fine-toothed combs, jumbo combs and curling combs.

Such combs are designed and produced for the lifting and the arrangement of hair. But since the support frames for the combs are thick, and the frames, including the comb teeth, are heavy, using the combs by inserting them along the hairline on the sides of the hair is not feasible. Further, since the teeth of these combs are not very thick, the hair must be lifted a number of times while using a hair dryer and while using a hair spray for fixing the hair style, and as a great deal of time is therefore required before a hair arrangement can be completed, it is not easy to use these combs for lifting hair.

SUMMARY OF THE INVENTION

To resolve the above shortcomings, it is an object of the present invention to provide an easy hair lifting method whereby hair can be lifted easily using an appropriate hair lifting comb, and a hair lifting comb and a collapsible hair lifting comb.

According to the present invention, a hair lifting method comprises the steps of:

applying mousse in advance to a portion of hair to be lifted in order to maintain a hair style;

inserting a comb, the maximum height of which, from a scalp of a person, is 18 mm or greater, rearward of a head along the scalp from a point on the scalp that serves as a hairline;

lifting the hair to a predetermined height using the comb and fixing the hair; and removing the comb from the hair. Using this method, hair at a specific portion of hair can be lifted easily.

Further, according to the present invention, a hair lifting method comprises the steps of:

inserting a comb, the maximum height of which, from a scalp of a person, is 18 mm or greater, rearward of a head along the scalp from a point on the scalp that serves as a hairline;

lifting the hair to a predetermined height using the comb and applying a hair spray for stabilizing a hair style by fixing the hair; and removing the comb from the hair. Using this method, hair at a specific portion of hair can be lifted easily.

A hair lifting comb according to the present invention comprises:

a plurality of teeth;

a supporting member to which the plurality of teeth are attached; and side members for supporting the supporting member at a maximum height from a person's scalp of 18 mm or greater. Using this comb, a specific portion of hair can be lifted easily.

Specifically, the supporting member of the hair lifting comb is bar shaped, while the teeth that extend outward from the supporting member have the same thickness as the supporting member, and distal ends of the teeth are shaped like bird beaks. As a result, the weight of the comb is reduced to prevent it from falling, and because the distal ends of the teeth are shaped like bird beaks, the comb can be easily inserted into the hair without scratching the scalp.

In addition, the side members of the hair lifting comb are triangularly shaped, and these triangular side members are hollow. Thus, the weight of the comb is reduced to prevent it from falling.

A hair lifting comb according to the present invention comprises:

a plurality of teeth; and a supporting member to which the plurality of teeth are attached, the supporting member being bent into a hemispherical shape or into a semi elliptical shape, with a maximum height from a person's scalp of 18 mm or greater. With this comb, a specific portion of hair can be lifted easily.

A collapsible hair lifting comb according to the present invention comprises a supporting member and a plurality of teeth, whereof the teeth of the comb that are connected at an end of the supporting member are shorter than teeth that are connected at the central location of the supporting member, and whereof the supporting member is susceptible to be bent so that a maximum height from a person's curved scalp of 18 mm or greater is attained. As a result, a comb that is flat can easily be employed as a hair lifting comb.

A collapsible hair lifting comb according to the present invention comprises a supporting member and a plurality of teeth, wherefor are provided side members that are attached to either end of the supporting member whereon the plurality of teeth are arranged, and wherefor the comb can be bent at junctures of the side members and the supporting member so that a maximum height from a person's curved scalp of 18 mm or greater is attained. As a result, a comb that is flat can easily be employed as a hair lifting comb.

A collapsible hair lifting comb according to the present invention comprises a supporting member and a plurality of teeth, wherefor is provided a band portion, which is attached to the supporting member, that includes a band main body, having an engagement portion, and a band fixing portion, having an engagement securing portion, and wherefor the engagement portion and the engagement securing portion can be secured to each other when the supporting member is so bent that a maximum height from a person's curved scalp of 18 mm or greater is attained. As a result, a comb that is flat can easily be employed as a hair lifting comb.

A collapsible hair lifting comb according to the present invention comprises a supporting member and a plurality of teeth, wherefor are provided first and second side members, which are so used that a maximum height from a person's curved scalp of 18 mm or greater is attained, that are attached to either end of the supporting member, whereon the plurality of teeth are arranged; wherefor a band portion, which is attached to the first side member, has an engagement portion, and the second side member has an engagement securing portion; and wherefor the engagement portion and the engagement securing portion can be secured to each other when the comb is bent at junctures of the supporting member and the first and the second side members. As a result, a comb that is flat can easily be employed as a hair lifting comb.

A collapsible hair lifting comb according to the present invention comprises a supporting member and a plurality of teeth, wherefor are provided side members, which are so used that a maximum height from a person's curved scalp of 18 mm or greater is attained, are attached to either end of the supporting member whereon the plurality of teeth are arranged, while a fold-in portion is attached to the supporting member and an accessory portion is attached to the side members; wherefor the fold-in portion has a protruding or recessed connection portion and the accessory portion includes a recessed or protruding connection portion; and wherefor, when the comb is bent at junctures between the supporting member and the side members and at a juncture of the supporting member and the fold-in portion, the connection portion of the fold-in portion and the connection portion of the accessory portion can be securely fixed to each other. As a result, a comb that is flat can easily be employed as a hair lifting comb.

A collapsible hair lifting comb according to the present invention comprises a supporting member and a plurality of teeth, wherefor a plurality of notches are formed in an inner face of the supporting member, so that, when the supporting member is bent, a maximum height from a person's curved scalp of 18 mm or greater is attained, and wherefor those of the notches having a large width are provided at a portion whereat the supporting member is acutely bent. As a result, a comb that is flat can easily be employed as a hair lifting comb.

A collapsible hair lifting comb according to the present invention comprises a supporting member and a plurality of teeth, wherefor is provided an attachment portion that is attached to an end of the supporting member, and wherefor an attachment, which is so used that a maximum height from a person's curved scalp of 18 mm or greater is attained, can be attached to the attachment portion. As a result, a comb that is flat can easily be employed as a hair lifting comb.

A hair lifting comb according to the present invention comprises a plurality of teeth and a supporting member connected to the plurality of teeth, wherefor a heat generation member, for generating heat when power is supplied thereto, is provided inside the teeth and the supporting member, and wherefor a conductive terminal, to which power is externally supplied, and a thermostat, for preventing the heat generation member from rising to a specific temperature or higher, are provided for the supporting member. When power is supplied to the heat generation member via the conductive terminal for the generation of heat, and when the comb is inserted into a portion of hair to be lifted, the hair arrangement is set by the heat, and the comb is thereafter removed from the hair when it has cooled. In this manner, hair can be lifted easily.

A hair lifting comb according to the present invention comprises a plurality of teeth and a supporting member connected to the plurality of teeth, wherefor a heat generation member, for generating heat when power is supplied thereto, is located inside the teeth and the supporting member, and wherefor a power plug, to which external power is directly supplied, a thermostat, for preventing the heat generation member from rising to a specific temperature or higher, and a fuse, for preventing an excessive current from reaching the heat generation member, are provided for the supporting member. When power is supplied to the heat generation member via the power plug to generate heat, and when the comb is inserted into a portion of hair that is to be lifted, the hair arrangement is set by the heat and the comb is thereafter removed from the hair when it has cooled. In this manner, hair can be lifted easily.

A hair lifting comb according to the present invention comprises a plurality of teeth and a supporting member connected to the plurality of teeth, wherefor is provided a heat discharge member, which absorbs, accumulates and discharges externally provided heat, and is positioned inside the teeth. When the heat discharge member discharges heat acquired from an external heat source, such as steam, and when the comb is inserted into a portion of hair that is to be lifted, the hair arrangement is set by the heat, and the comb is thereafter removed from the hair when it has cooled. As a result, the hair can be lifted easily.

DETAILED DESCRIPTION OF THE PREFERRED EMBODIMENTS

The preferred embodiments of the present invention will now be described while referring to the accompanying drawings.

According to a first hair lifting method of the present invention, a hair lotion for maintaining the condition of a hair style is applied in advance to a portion of hair to be lifted. Then, a comb, having a maximum height from a person's scalp near a hairline of 18 mm or higher, is inserted toward the rear of the person's head and lifts the hair to a predetermined height. The portion of hair that extend from the comb fall downward and the comb is removed when a predetermined period of time has elapsed. Then, a specific portion of hair can be lifted easily. For a predetermined period before the comb is removed, the hair may be dried using a hair dryer to reduce the time required for arranging the hair.

According to a second hair lifting method of the present invention, a comb, the maximum height of which is 18 mm or greater measured from the scalp and along a hairline, is inserted toward the rear of the head to lift the hair an adequate distance. The hair is lifted and held at a predetermined height by the comb, with the hair that protrudes through the comb hanging down. Hair spray is then blown on the hair to fix it for the hair style and the comb is removed after a predetermined period of time has elapsed. As a result, a specific portion of hair can be lifted easily. In the period during which the hair is being set, the hair can be dried using a hair dryer to reduce the time required for arranging the hair.

Figure 1:
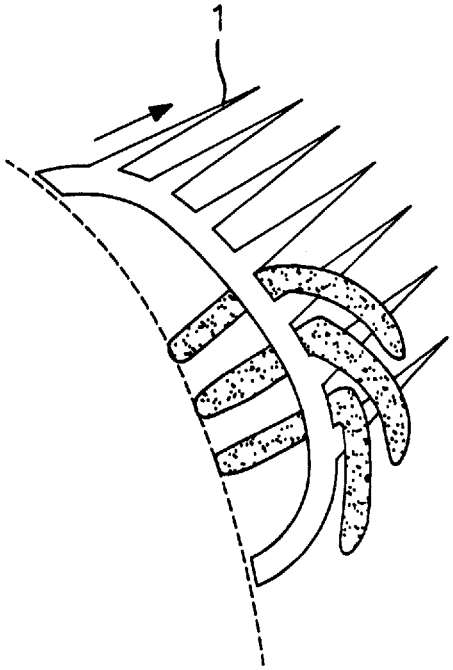
FIG. 1 is a diagram for explaining a method for raising hair according to one embodiment of the present invention.

The first hair lifting method according to the embodiment of the present invention will now be described while referring to FIG. 1. FIG. 1 is a diagram for explaining a hair lifting method according to the embodiment of the present invention. It should be noted that in FIG. 1 the drawings of a hair lifting comb 1, the scalp of the head and the hair are simplified for convenience sake. The portion represented by the broken line is the hairline on the scalp.

As is shown in FIG. 1, hair lotion, such as mousse, is applied to the hair to fix and style it, and the hair lifting comb 1, which has a maximum height measured from the hairline on the scalp of 18 mm or greater, is inserted along the hairline toward the rear of the head (in the direction indicated by an arrow in FIG. 1). Strands of hair pass through the teeth of the hair lifting comb 1 and the portions that protrude therefrom hang down. The hair is then held in this manner until it dries, or it is dried by using a hair dryer.

"The maximum height of the hair lifting comb 1 from the hairline scalp is 18 mm or greater" means that when the hair lifting comb 1 is inserted into hair, the maximum height of the comb 1 measured from the curved scalp is 18 mm or greater, not that when the comb 1 is placed on a flat surface its maximum height is 18 mm or greater. If the height of the comb 1 is less than 18 mm from the surface of the curved scalp, lifting the hair to a satisfactory height, which is the feature of the present invention, can not be accomplished.

According to the second hair lifting method of the embodiment of the present invention, as is shown in FIG. 1, the hair lifting comb 1, the maximum height of which measured from the hairline on the scalp is 18 mm or greater, is inserted along the hairline toward the rear of the head (in the direction indicated by the arrow in FIG. 1). Strands of hair pass through the teeth of the hair lifting comb 1 and the portions that protrude therefrom hang down. While the hair is held in this fashion, a hair spray is applied to the hair to fix and style it, and the hair is allowed to set until it dries, or the hair is dried by using a hair dryer.

Figure 2A:
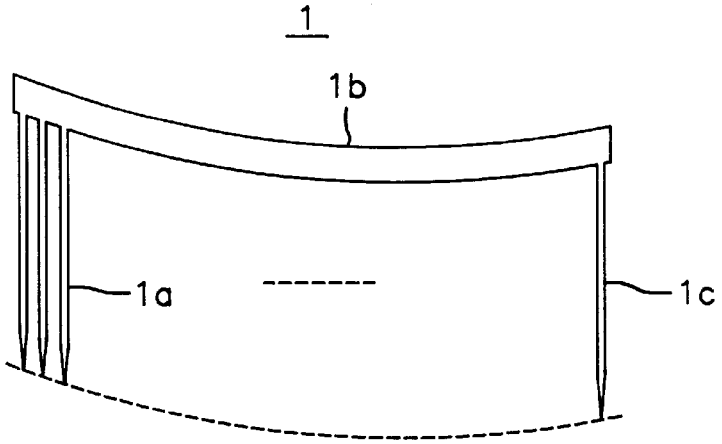
FIG. 2A is a schematic front view of a first comb.
Figure 2B:
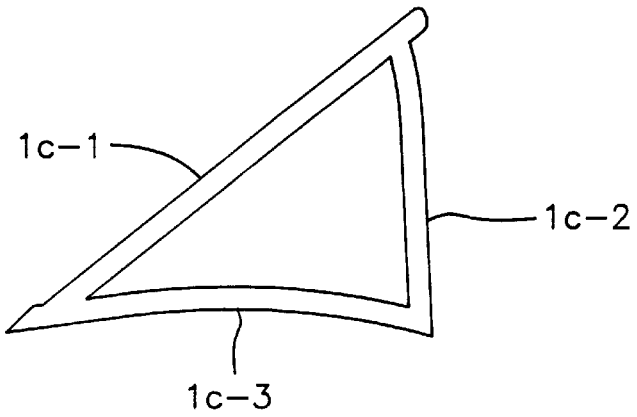
FIG. 2B is a schematic right side view of the first comb.
Figure 2C:
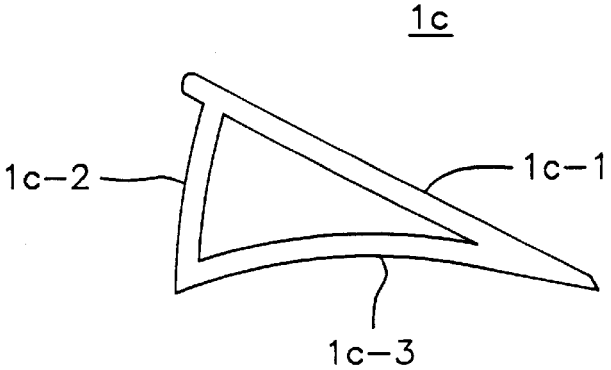
FIG. 2C is a schematic left side view of the first comb.

A first hair lifting comb (a first comb) that is employed to accomplish the hair lifting method of the present invention will be described while referring to FIGS. 2 and 3. FIG. 2A is a schematic front view of a first comb; FIG. 2B is a schematic right side view of the first comb; FIG. 2C is a schematic left side view of the first comb; and FIG. 3 is a diagram depicting the external appearance of the first comb.

Figure 3:
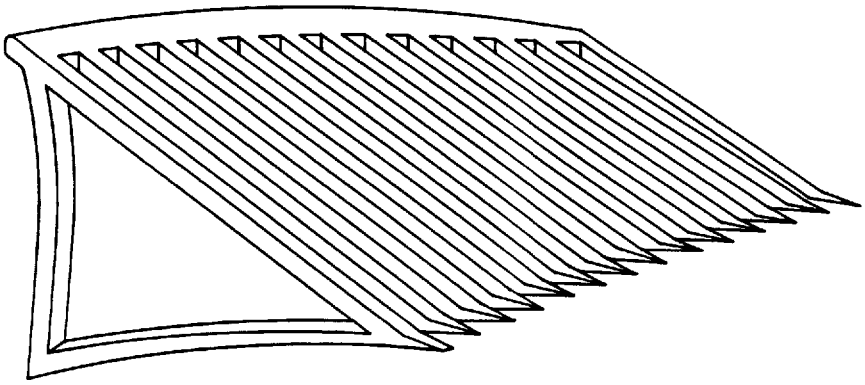
FIG. 3 is a diagram depicting the external appearance of the first comb.

As is shown in FIGS. 2 and 3, a first comb 1 consists of a plurality of teeth 1*a*, a supporting member 1*b* to which the teeth 1*a* are connected, and side members 1*c* whose height is such that the supporting member 1*b* is held away from the scalp in order to lift hair.

The first comb 1 shown in FIG. 2 and 3 is so designed that its height and its depth are greater on the right than on the left, and is intended to be used on the left side of the head. In other words, with this comb 1, the hair on the same side as the left ear is lifted higher than hair towards the center of the head. Thus, a comb to be used on the right side of the head is so formed that its shape and that of the comb in FIGS. 2 and 3 are symmetrical.

Specific, individual sections of the first comb 1 will now be explained.

The distal ends of the teeth 1*a* that contact the scalp are shaped like birds' beaks, and the roots are fixed to the supporting member 1*b*. Since the distal ends are shaped like birds' beaks, the comb can easily conform to the shape of the head and will not cause injury to the scalp. The example comb in FIG. 2 is so designed that the teeth near its right side are longer and the teeth near its left side are shorter. Further, for the example comb in FIG. 2, the teeth 1*a*, from the roots to the distal ends, are narrow, with a width of about 4 mm, which is the same as the thickness of the supporting member 1*b*.

The supporting member 1*b* is a thin rod that is gradually bent in the direction of the height relative to the scalp. The side members 1*c* are attached at the ends, and the teeth 1*a* are connected to the supporting member 1*b* and fill the interval between the side members 1*c*. The distal ends of the teeth 1*a* and the side members 1*c* are aligned in the same direction. In this case the direction is that in which the teeth 1*a* and the side members 1*c* contact the scalp, proceeding from the hairline toward the rear of the head, along a line that is almost parallel to the supporting member 1*b* when the supporting member 1*b* is positioned along the hairline while maintaining a specified height.

When the supporting member 1*b* is positioned along the hairline, it may be either directly or gradually curved relative to the line. The supporting member 1*b* in FIG. 2 is so designed that its center portion gradually curves toward the rear of the head relative to the hairline. It should be noted that the supporting member 1*b* in FIG. 2 has a thickness of about 4 mm, which is the same as that of the teeth 1*a*.

As is shown in FIGS. 2B and 2C, to reduce the weight, the frames of the side members 1*c* are hollow and have a substantially triangular shape.

More specifically, the side members 1*c*, which are fixed to the supporting member 1*b*, each consist of a first frame member 1*c*-1, which is formed and extends in the same direction as the teeth la; a second frame member 1*c*-2, which, at one end near the supporting member 1*b*, is fixed to the first frame member 1*c*-1 and which is so positioned that it contacts the scalp at the other end; and a third frame member 1*c*-3, which, at one end near the scalp, is fixed to the second frame member 1*c*-2 and which is fixed to the first frame member 1*c*-1 farther from the supporting member 1*b* (at the end extending in the same direction as the distal ends of the teeth 1*a*) at the other end.

The first frame members 1*c*-1 have basically in the same shape as the teeth 1*a*, and the second frame members 1*c*-2 and the third frame members 1*c*-3 are fixed to them at either end. Thus, the distal ends of the frame members 1*c*-1 that are farthest from the supporting member 1*b* are shaped like birds' beaks, as are the teeth 1*a*. Since the ends are shaped like birds' beaks, the first comb 1 can easily slide into the hair.

The second frame members 1*c*-2 are used to establish the height for the first comb 1. With these frame members, the height measured from an actual scalp to the supporting member 1*b* is 38 mm at the maximum and 18 mm at the minimum in this embodiment. In the example in FIG. 2, the right side of the first comb 1 is the highest and the left side is the lowest.

Since the second frame members 1*c*-2 are provided, the tangling of hair can be prevented when the first comb 1 is removed from the hair.

The third frame members 1*c*-3 are curved so that they lie along the scalp and correspond in shape to the scalp. With this shape, the first comb 1 can be fitted to the scalp. In the example in FIG. 2, the frame is longer on the right and shorter on the left.

A method for using the first comb 1 will now be described.

First, hair lotion, such as hair mousse, is applied to the hair above the left ear, and the distal ends of teeth 1*a* of the first comb 1 are inserted in the hair adjacent to the scalp, with the supporting member 1*b* at the front, from the hairline toward the rear of the head, so that hair strands slide between the teeth 1*a*. The hair that protrudes from the teeth 1*a* is brushed downward from the ear so that the hair is lifted sufficiently. Then, a hair dryer is used to dry the hair and the first comb 1 is removed. As a result, the hair above the left ear is so arranged that it rises from the scalp to a height that is established by the teeth 1*a*.

In the above example, hair mousse is employed. However, after the first comb 1 is inserted into the hair and the hair is brushed, a hair spray for fixing and styling the hair may be blown on the hair, and the hair may thereafter be dried using a hair dryer and the comb 1 be removed.

Figure 4:
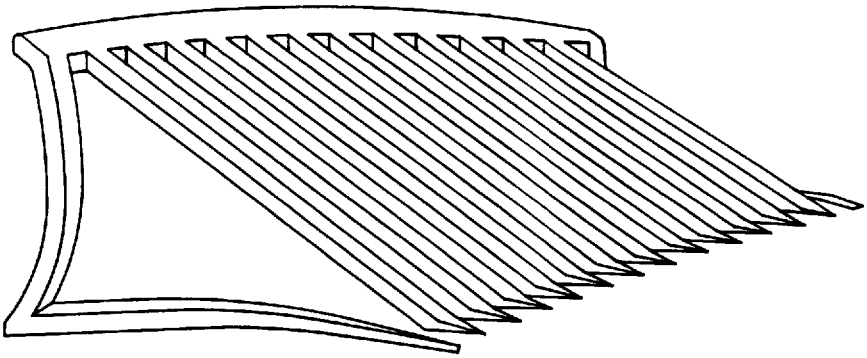
FIG. 4 is a diagram depicting the external appearance of a second comb.

A second hair rasing comb (second comb) according to the embodiment of the present invention will now be described while referring to FIG. 4. FIG. 4 is a diagram depicting the external appearance of the second comb.

The difference between a second comb 2 and the first comb 1 is that the design of the first frame members 1*c*-1 of the side members 1*c* of the first comb 1 is changed by removing the portions that connect the second frame members 1*c*-2 to the third frame members 1*c*-3. With this structure, in addition to the effect obtained by the first comb 1, the weight of a comb can be reduced even further. Compared with the first comb 1, manufacturing procedures using dies are easy, and manufacturing costs can be reduced.

It should be noted that the method for employing the second comb 2 is the same as that for the first comb 1.

Figure 5A:
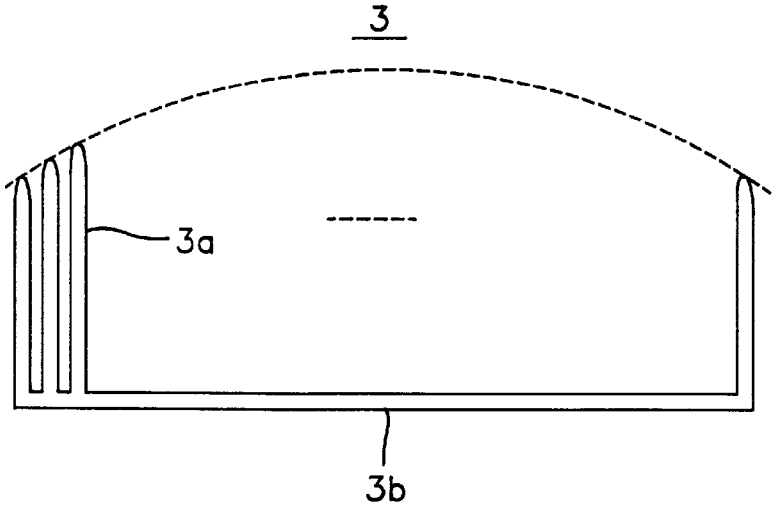
FIG. 5A is a schematic front view of a third comb.
Figure 5B:
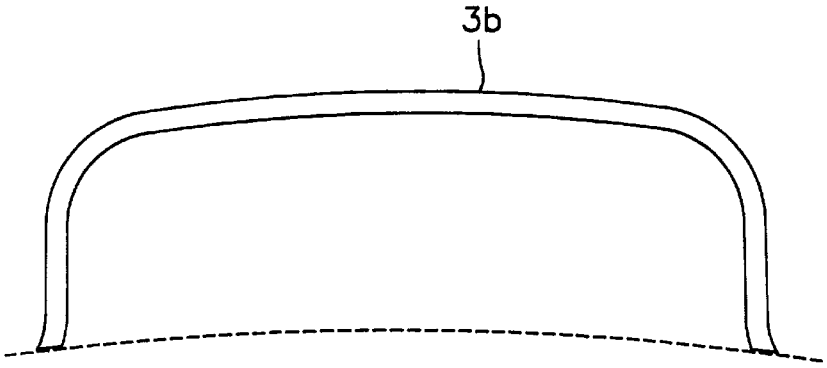
FIG. 5B is a schematic right side view of the third comb.
Figure 5C:
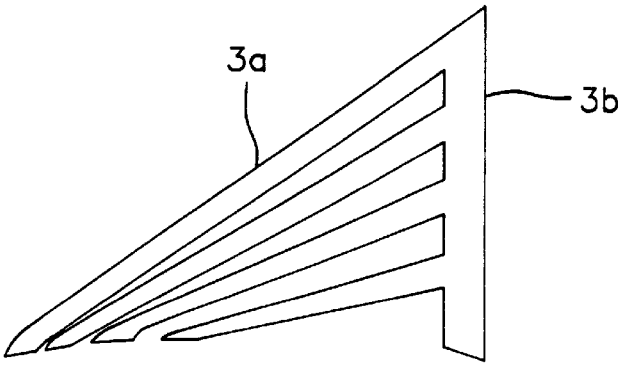
FIG. 5C is a schematic left side view of the third comb.

A third hair rasing comb (a third comb) according to the embodiment of the present invention will now be described while referring to FIGS. 5 and 6. FIG. 5A is a schematic front view of a third comb; FIG. 5B is a schematic right side view of the third comb; FIG. 5C is a schematic left side view of the third comb; and FIG. 6 is a diagram depicting the external appearance of the third comb.

Figure 6:
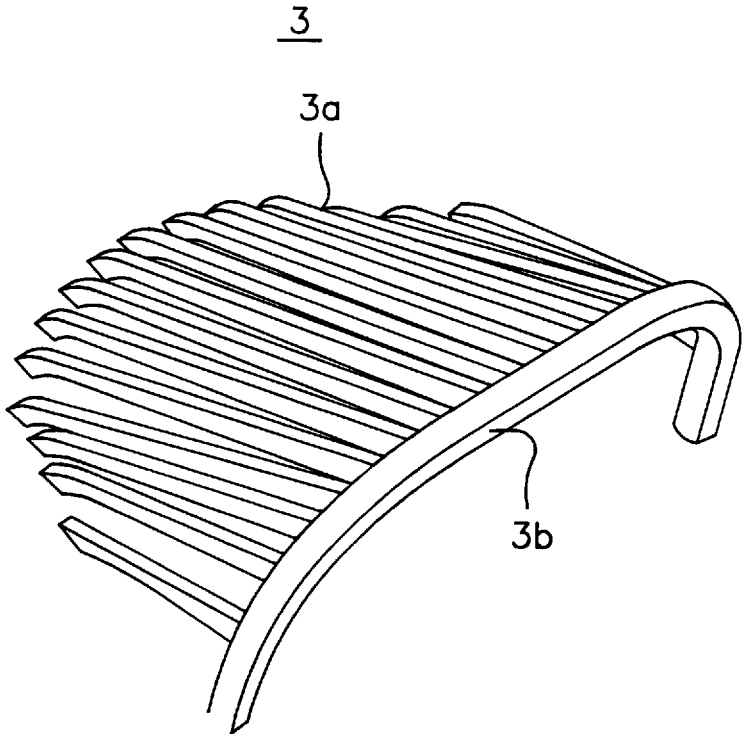
FIG. 6 is a diagram depicting the external appearance of the third comb.

As is shown in FIGS. 5 and 6, a third comb 3 consists of a plurality of teeth 3*a* and a supporting member 3*b* to which the teeth 3*a* are connected.

The third comb in FIGS. 5 and 6 is used to raise hair above the forehead.

Specific, individual sections of the third comb 3 will now be explained.

The distal ends of the teeth 3*a* that contact the scalp are so formed that they are shaped like a bird's beak, and their roots are fixed to the supporting member 3*b*. As the distal ends are formed like birds beaks, the teeth 3*a* easily conform to the shape of the scalp and will not cause injury to the scalp. Further, the third comb 3 can slide into the hair easily. The example in FIG. 5 is so designed that in the center the teeth 3*a* are long but become shorter the nearer they are to either side. The teeth 3*a*, extending outward their distal ends, have the same thickness as has the supporting member 3*b*, i.e., about 4 mm.

In the example in FIG. 5C, the teeth 3*a* are not formed at the ends of the supporting member 3*b* that contact the scalp. However, some teeth 3*a* may extend from the ends of the supporting member 3*b* that contact the scalp in the same direction as the other teeth, so that these teeth 3*a* contact the scalp. With this structure, the hair can be easily lifted from end to end of the supporting member 3*b* of the third comb 3.

The supporting member 3*b* is a thin bar that is curved in a substantially hemispherical, semielliptical or semicylindrical shape in the direction of the height relative to the scalp. The ends of the supporting member 3*b* contact the scalp and the teeth 3*a* are connected across the width of the supporting member 3*b*. When the supporting member 3*b* is positioned along the hairline, the teeth 3*a* contact the scalp from the hair line toward the rear of the head along a moderate hemispherical curve relative to the supporting member 3*b*.

It should be noted that in the example shown in FIG. 5, the thickness of the supporting member 3*b* is approximately 4 mm.

The third comb 3 in FIG. 5 is so designed that to satisfactorily lift the hair the height from the scalp to the supporting member 3*b* is about 40 mm. It should be noted, however, that a height of 18 mm or greater is adequate for lifting the hair.

The method of employment for the third comb 3 is almost the same as that for the first comb 1. The only differences are that the location where the third comb 3 is inserted is in the hair above the forehead, and that the direction in which the hair is brushed depends on the taste of a user, as the hair may be brushed either to the left or to the right.

Figure 7:
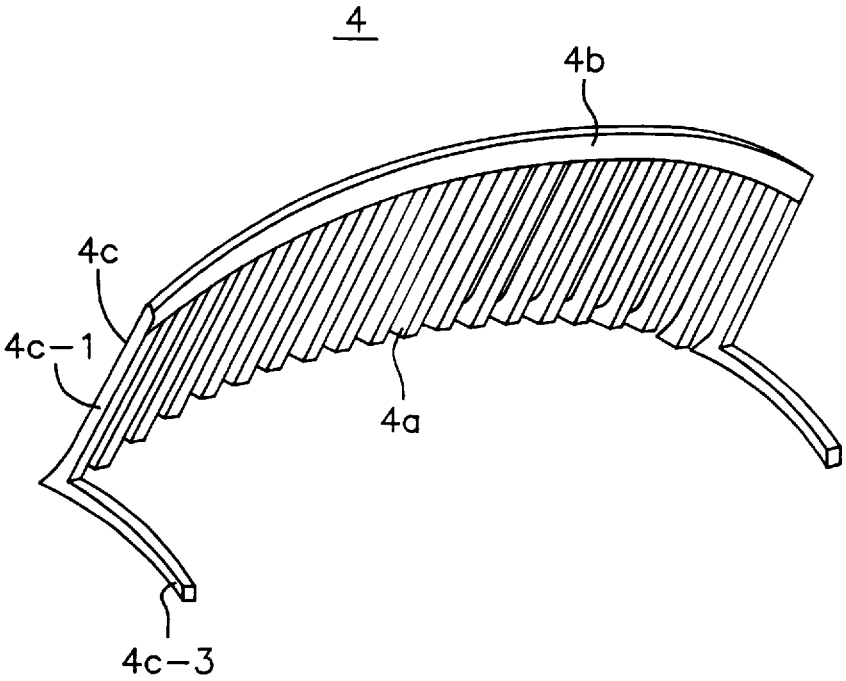
FIG. 7 is a diagram depicting the external appearance of a fourth comb.

A fourth hair lifting comb (a fourth comb) according to the embodiment of the present invention will now be described while referring to FIG. 7. FIG. 7 is a diagram depicting the external appearance of a fourth comb.

A four th comb 4 is a modification of the first comb 1. The difference from the first comb 1 is that the second frame member 1*c*-2 of the side member 1*c* is formed by removing a portion that connects the first frame member 1*c*-1 to the third frame member 1*c*-3. That is, a plurality of teeth 4*a* are connected to a supporting member 4*b*, first frame members 4*c*-1 of side members 4*c* are attached to the ends of the supporting member 4*b*, and the ends of third frame members 4*c*-3 are fixed to the ends of the first frame members 4*c*-1 at points farthest from the supporting member 4*c*. Therefore, the side members 4*c* have an L shape. With this structure, the weight of the fourth comb 4 can be further reduced.

The method for employing the fourth comb 4 is the same as that for the first comb 1.

Figure 8:
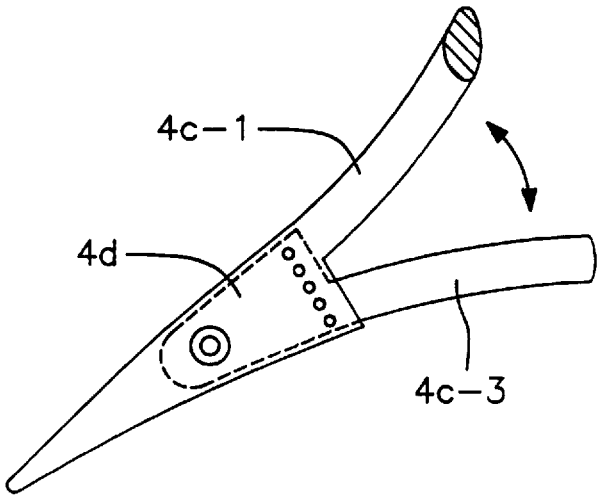
FIG. 8 is a partial diagram for explaining a side member for a modification of the fourth comb.

A modification of the fourth embodiment will now be described while referring to FIGS. 8 and 9. FIG. 8 is a partial diagram depicting a side member of a modification of a side member of the fourth comb, and FIG. 9 is a partial diagram depicting the external appearance of the modification for the fourth comb.

Figure 9:
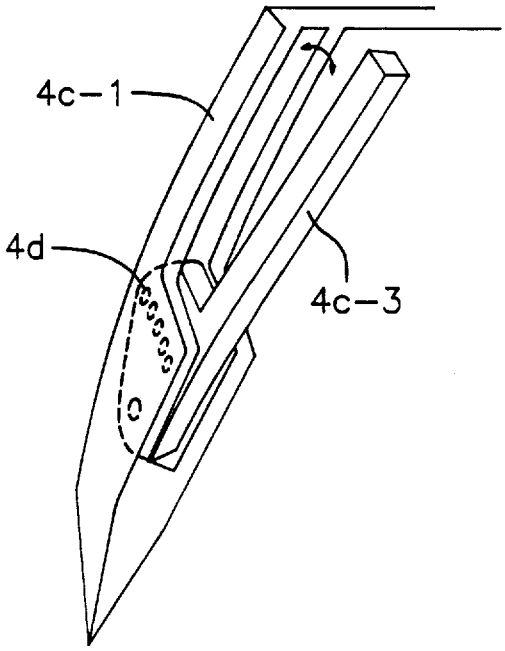
FIG. 9 is a partial diagram depicting the external appearance of the side member for the modification of the fourth comb.

As is shown in FIGS. 8 and 9, a third frame member 4*c*-3 of a side member 4*c* is attached to a first frame member 4*c*-1 so that it is movable in the directions indicated by arrows. That is, the distal end whereat the first frame member 4*c*-1 is coupled with the third frame 4*c*-3 serves as a movable portion 4*d*.

Since the movable portion 4*d* is provided, the distance between the scalp and the supporting member 4*c* can be adjusted, and the height for lifting hair can be arbitrary set.

Figure 10:
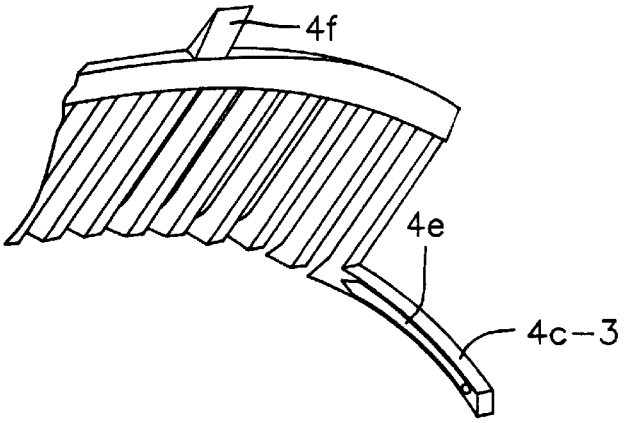
FIG. 10 is a partial diagram depicting the external appearance of another modification of the fourth comb.

Another modification of the fourth comb will now be described while referring to FIG. 10. FIG. 10 is a partial diagram depicting another modification of the fourth comb.

As is shown in FIG. 10, in this modification of the fourth comb, a hair holder 4*e* is attached to a third frame member 4*c*-3 of a side member 4*c* on the teeth side, and a handle 4*f* is provided on the supporting member 4*b* to easily remove the fourth comb 4 from the hair.

According to this modification of the fourth comb, hair can be easily fixed by using the hair holder 4*e* , and the fourth comb 4 can be easily removed by using the handle 4*f*.

The hair holder 4*e* and the handle 4*f* can be applied not only for the fourth comb 4 but also for the first through the third combs.

Figure 11:
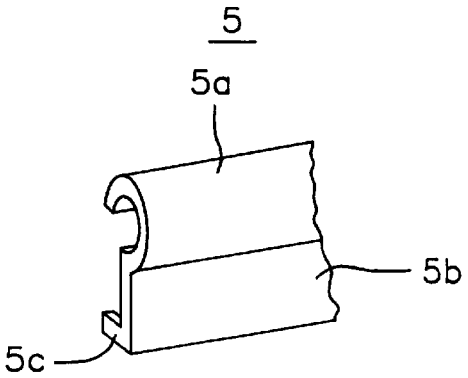
FIG. 11 is a perspective view of an example hair depressing tool of a hair lifting comb according to the embodiment of the present invention.
Figure 12:
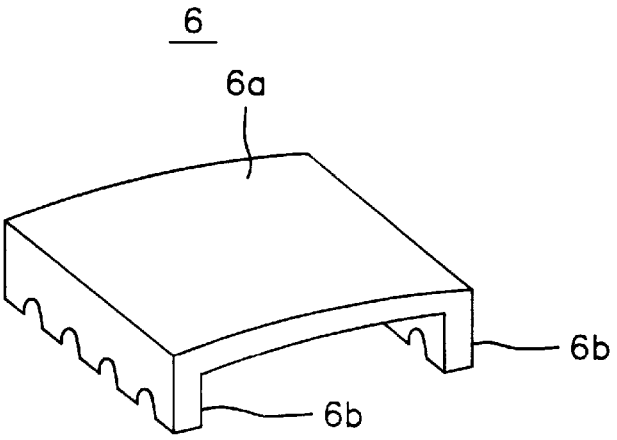
FIG. 12 is a perspective view of another example hair depressing tool of a hair lifting comb according to the embodiment of the present invention.

A hair depressing tool for a hair lifting comb according to the embodiment of the present invention will now be described while referring to FIGS. 11 and 12. FIGS. 11 and 12 are perspective views of an example hair depressing tool for a hair lifting comb according to the embodiment of the present invention.

A hair depressing tool 5 in FIG. 11 consists of an engagement portion 5*a*, for engaging a supporting member for a hair lifting comb, and a plate portion 5*b* for holding down hair that protrudes from the teeth of the comb.

According to a method for using the hair depressing tool in FIG. 11, the engagement portion 5*a* engages the supporting member of the hair lifting comb, and the comb is inserted into the hair. While the hair protrudes from the teeth of the comb, the plate portion 5*b* is rotated toward the teeth to hold down the hair that protrudes extended from the teeth. So long as the plate portion 5*b* is so designed that it rotates toward the teeth of the comb, the connection of the supporting member and the engagement portion 5*a* may employ any kind of form.

In addition, a pawl 5*c* may be provided for the plate portion 5*b* to insert and fix to the teeth of a comb, thereby securely holding the hair down.

A hair depressing tool 6 shown in FIG. 12 consists of a plate portion 6*a* and leg portions 6*b* that are attached to the ends of the plate portion 6*a*. The leg portions 6*a* are in a comb shape, and when a hair lifting comb is held with this tool, hair can be drawn downward between the comb teeth of the leg portions 6*b*.

To employ the hair depressing tool 6 in FIG. 12, a hair lifting comb is inserted into the hair and the hair is drawn between the teeth. In this condition, the hair depressing tool 6 is attached so that the leg portions 6*b* are inserted and fixed to the teeth of the comb. That is, the hair depressing tool 6 is located so that the teeth intersect the plate portion 6*b* at a right angle, and the leg portions 6*b* flexibly engage the teeth.

The hair depressing tools 5 and 6 shown in FIGS. 11 and 12 are attached and fixed to the hair lifting comb. However, these tools may be employed to fix a ornamental comb in place for a long period of time. In this case, if the plate portion 5*b* of the hair depressing tool 5 and the plate portion 6*a* of the hair depressing tool 6 are decorated, the tools can effectively serve as ornamental combs.

Figure 13:
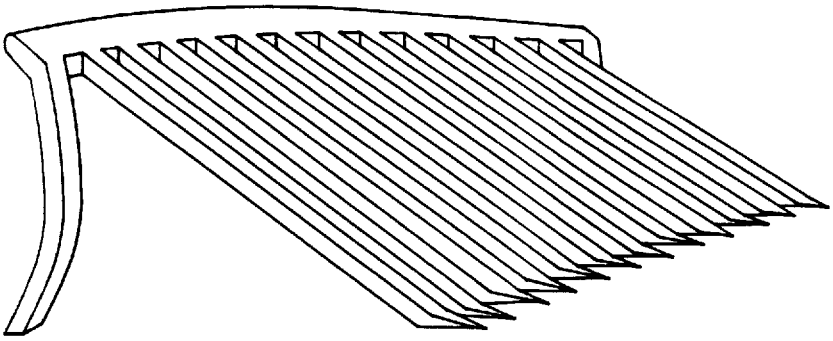
FIG. 13 is a diagram depicting the external appearance of a fifth comb.

A fifth hair lifting comb (a fifth comb) according to the embodiment of the present invention will now be described while referring to FIG. 13. FIG. 13 is a diagram depicting the external appearance of the fifth comb.

As is shown in FIG. 13, the fifth comb is a modification of the first comb land the second comb 2. More specifically, the side member 1*c* of the first comb 1 is constituted by only the second frame member 1*c*-2. With this structure, the manufacture of combs is simplified, and the weight of the comb is so reduced that the comb will seldom slip out of the hair.

Figure 14:
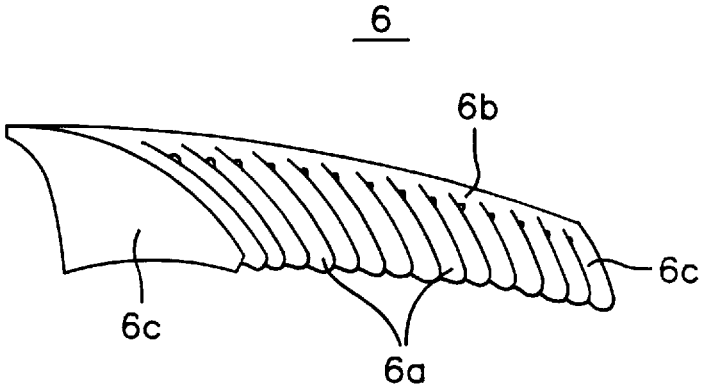
FIG. 14 is a diagram depicting the external appearance of a sixth comb.
Figure 15:
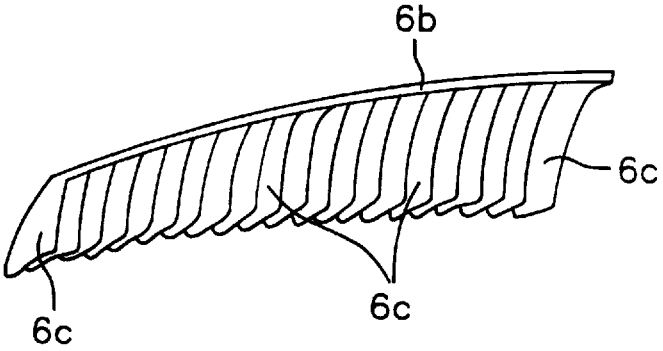
FIG. 15 is a diagram depicting the external appearance of the sixth comb.

A sixth hair lifting comb (sixth comb) according to the embodiment of the present invention will now be explained while referring to FIGS. 14 and 15. FIGS. 14 and 15 are diagrams depicting the external appearance of the sixth comb.

As is shown in FIGS. 14 and 15, a sixth comb 6 is so designed that a side member 6*c* has a triangular shape and teeth 6*a* also have a triangular shape. That is, the teeth 6*a* connected to a supporting member 6*b* have a thickness that is measured in the direction of the height to which the hair is lifted.

To reduce the weight of the sixth comb 6, the triangular center portions of the side members 6*c* and of the teeth 6*a*, as well as the first side members 1*c*, may be hollow.

According to the hair lifting methods and the hair lifting combs according to the embodiment, since hair is fixed and arranged by using a comb that lifts hair to the maximum height of 18 mm or greater measured from the scalp, a full formed hair style can be provided easily.

The present invention employs a hair lifting method according to which mousse is applied in advance to a portion of hair to be lifted; a comb, the maximum height of which, measured from the scalp is 18 mm or greater, is inserted toward the rear of a head along an area of the scalp that serves as a hairline; the hair is lifted to a predetermined height using the comb and fixed; and the comb is removed from hair. With this method, a specific portion of the hair can be lifted easily.

Further, the present invention employs a hair lifting method according to which a comb, the maximum height of which, measured from the scalp is 18 mm or greater, is inserted toward the rear of a head along an area of the scalp that serves as a hairline; the hair is lifted to a predetermined height using the comb and a hair spray is blown on the hair to fix it; and the comb is removed from hair. With this method, a specific portion of hair can be lifted easily.

According to the present invention, the first comb comprises: a supporting member to which a plurality of teeth are attached; and side members for supporting the supporting member at a maximum height of 18 mm or greater measured from the scalp. With this comb, hair at a specific portion can be lifted easily.

According to the present invention, the teeth of the first comb extend outward and have the same thickness as does the bar shaped supporting member, and the distal ends of the teeth are shaped like birds' beaks. As a result, the weight of the comb is reduced to prevent it from falling, and in addition the comb can be easily inserted into hair without the bird beak shaped distal ends of the teeth scratching the scalp.

In addition, since the first comb of this invention has hollow side members arranged in a triangular shape, the weight of the comb is reduced to prevent it from falling.

According to the first hair lifting comb of the present invention, since each side member has a first frame member formed parallel to the teeth, a second frame member formed parallel to the direction of the height of the supporting member, and a third frame member formed so that it conforms to the scalp, the weight of the comb can be reduced and the comb seldom falls.

According to the first hair lifting comb of the present invention, the side members hold the supporting member at a maximum height of 18 mm or greater measured from the scalp, and is constituted by the first, the second and the third frame members; the supporting member is bar shaped; and the teeth of the comb extending outward from the supporting member have the same thickness as the supporting members, and their distal ends are shaped like birdbeaks. As a result, the comb is light and seldom falls. Further, since the teeth have bird beak-shaped distal ends, the comb can easily slide into the hair without harming the scalp.

According to the second hair lifting comb of the present invention, since the side members consist of only the second frame member and the third frame member, the comb is lighter and seldom falls, and the comb manufacturing process can be simplified.

According to the second hair lifting comb of the present invention, since the side members hold the supporting member at a maximum height of 18 mm or greater measured from the scalp and are constituted by the second and the third frame members, and since the teeth of the comb, which have bird beak-shaped distal ends, that extend outward from the supporting member have the same thickness as the bar-shaped supporting member, the comb is lighter and is seldom dropped, and the comb manufacturing process can be simplified.

According to the third hair lifting comb of the present invention, since the side members consist of only the first and the third frame members, the comb is lighter and is seldom dropped, and the comb manufacturing process can be simplified.

According to the fifth hair lifting comb of the present invention, since the side members consist of only the second frame member, the comb is lighter and is seldom dropped, and the comb manufacturing process can be simplified.

According to the fourth hair lifting comb of the present invention, since the side members are bent in substantially a hemispherical or semielliptical shape, and since the maximum height of the supporting member measured from the scalp is 18 mm or greater, a specific portion of hair can be lifted easily.

According to the fourth hair lifting comb of the invention, the supporting member is a bar curved in substantially a hemispherical or semielliptical shape, the maximum height of the supporting member measured from the scalp is 18 mm or greater, and the extended teeth have bird beak-shaped distal ends and have almost the same thickness as the supporting member. As a result, the comb is lighter and seldom falls, and the comb can be easily inserted into the hair without harming the scalp because of the bird beak-shaped distal ends of the teeth. In addition, the comb manufacturing process can be simplified.

According to the fourth hair lifting comb of the present invention, the portion whereat the first frame and the third frame of the side member are coupled together serves as a movable portion that moves in the direction of the height of the supporting member. Thus, the height of the comb can be set arbitrarily.

According to the fourth hair lifting comb of the present invention, since a hair holder is provided for the third frame member of the side member, the comb seldom falls.

According to the fourth comb of the present invention, since a handle is provided for the supporting member, the comb can be easily removed from the hair.

According to the sixth hair lifting comb of the present invention, since the side members and the teeth have triangular shapes, a specific portion of the hair can be lifted easily.

When a collapsible hair lifting comb (a seventh comb) according to the present invention is used to lift hair, a flat comb is so bent that the maximum height of the comb measured from the scalp along the hair line is 18 mm or greater. Therefore, the seventh comb is a portable hair lifting comb that can be produced at a low manufacturing cost.

Further, the distal ends of a plurality of teeth can contact the surface of the scalp by adjusting the length of the teeth.

Figure 16:
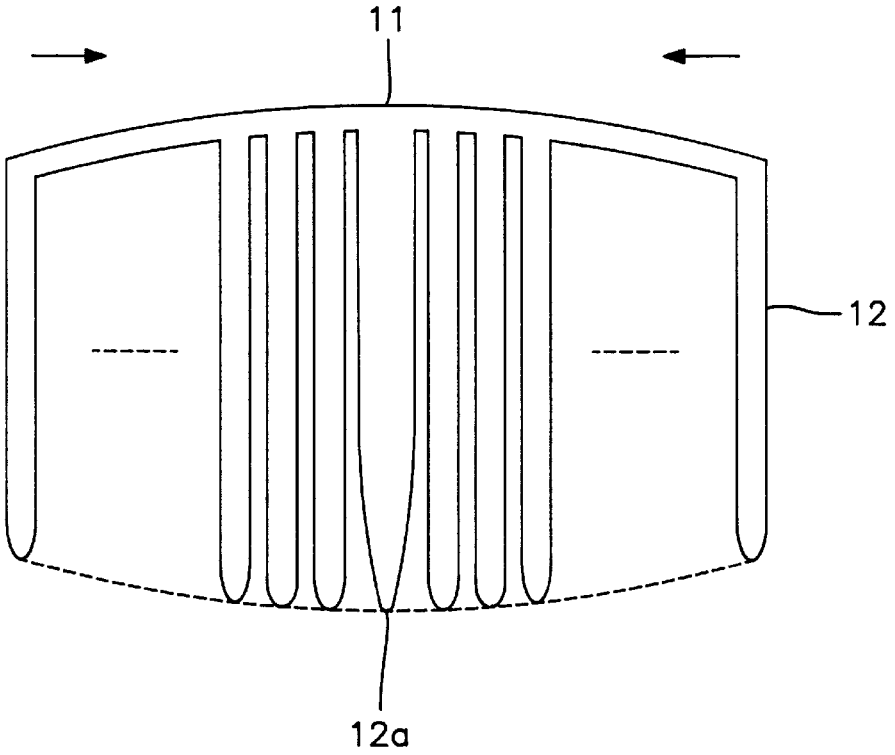
FIG. 16 is a schematic plan view of the structure of a seventh comb.
Figure 17:
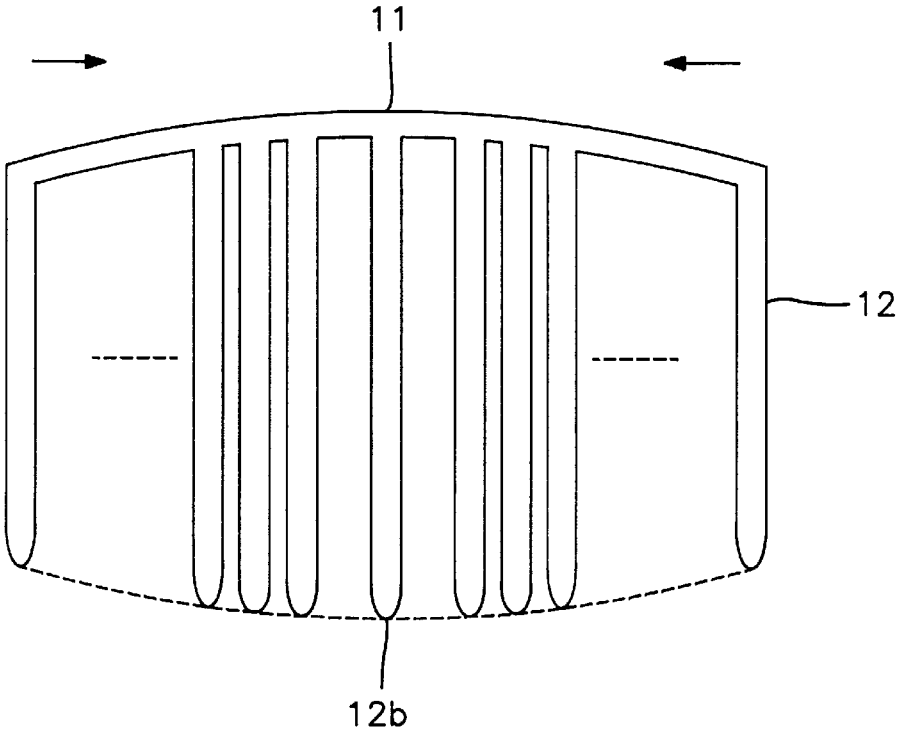
FIG. 17 is a schematic plan view of the structure of the seventh comb.

The structure of the collapsible hair lifting comb (the seventh comb) according to the embodiment of the present invention will now be described while referring to FIGS. 16 and 17. FIGS. 16 and 17 are schematic plan views of the structure of a collapsible hair lifting comb according to the embodiment of the present invention.

As is shown in FIGS. 16 and 17, the seventh comb is constituted by a curved supporting member 11 and teeth 12 that are connected to the supporting member 11. The center of the supporting member 11 can be set at a height 18 mm or greater by pulling the center portion of the supporting member 11 toward the front in the diagrams and by pushing both ends in the directions indicated by arrows to form a three-dimensional hair lifting comb. Further, the teeth 12 in the center are long and the teeth 12 at both ends are shorter, so that the distal ends of the teeth contact the surface of the scalp when the supporting member 11 is bent.

Although the supporting member 11 of the seventh comb is curved in FIGS. 16 and 17, it may be linearly formed.

The seventh comb is made of thick paper, light metal, vinyl chloride or polypropylene.

When the seventh comb is made of thick paper cut into a shape shown in FIG. 16 or 17, the manufacturing costs are very low. However, it is difficult for this comb to maintain a shape that provides a maximum height of 18 mm, and when mousse is used the durability of the comb is deteriorated. This type of comb, therefore, is suitable for one time use when on a trip, etc.

The light metal that is used for the seventh comb is preferably a material, such as wire, that can keep its shape when the supporting member 11 is bent. The metal may be covered with vinyl chloride.

When the seventh comb is made of vinyl chloride, such as hard vinyl chloride, it can keep its shape when the supporting member 11 is bent.

A seventh comb that is made of polypropylene will not be broken even though the supporting member 11 is bent many times.

In addition, the comb in FIG. 16 is so designed that the tooth 12*a* in the center is wider than the other teeth, and since the hair in the center is parted with this tooth 12*a*, this tooth is very effective when used for a hair style having a center part. Although in FIG. 16 the center tooth is wide, the tooth may be positioned either on the left or on the right side, and the position where the wide tooth is located is where the hair is parted.

Further, for the comb in FIG. 17, no immediately adjacent teeth are provided to the right and to the left of the centrally located tooth 12*b*. Since more hair is drawn through the open portions alongside the tooth 12*b*, the hair that is drawn through is held down on both sides to part the hair in the center. Although in FIG. 17 the tooth 12*b* is located in the center, it may be positioned either to the right or to the left.

Figure 18:
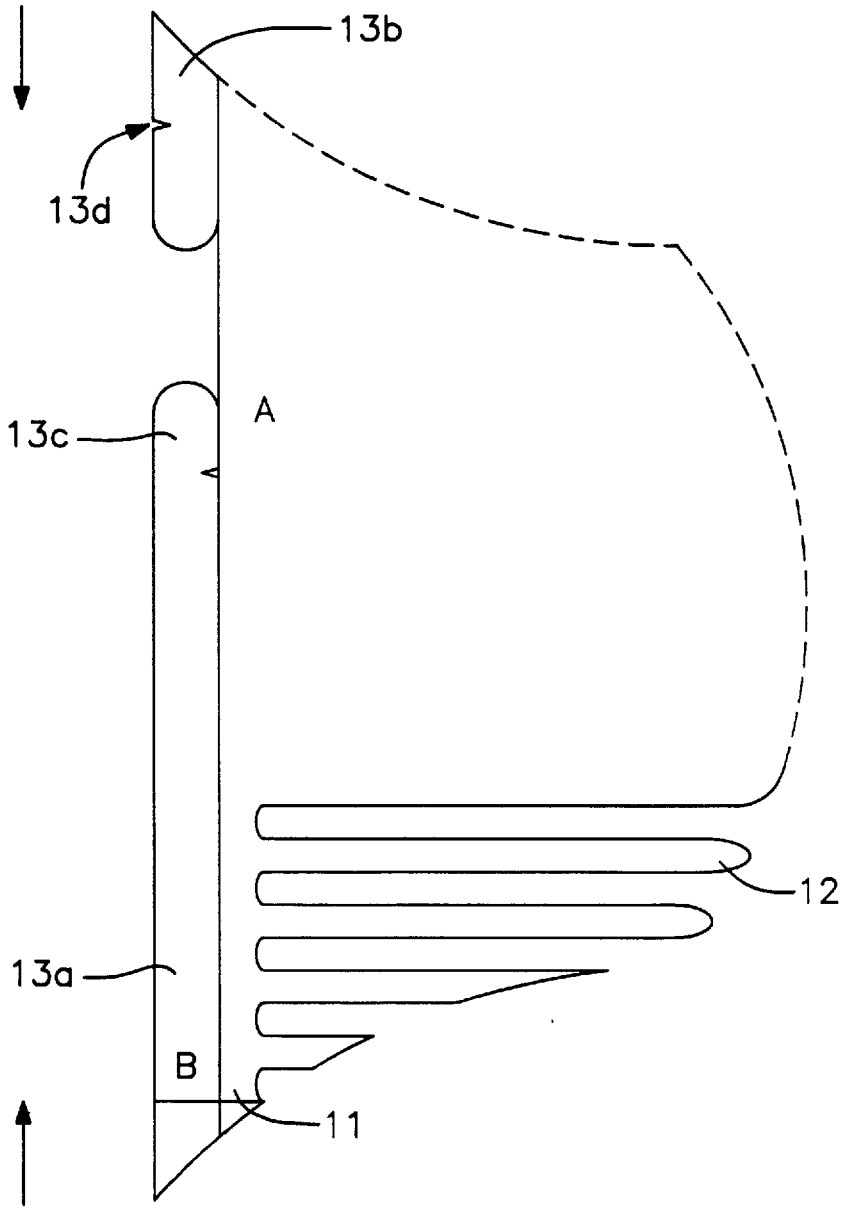
FIG. 18 is a plan view of an eighth comb.

The teeth of the combs in FIGS. 16 and 17 can have the same shape as those in FIG. 18. That is, the lengths of all the teeth, except for the teeth at either end, are adjusted so that the teeth form a moderate arch. The teeth at either end are extremely shorter than the others. With the thus formed teeth in FIG. 18, when the supporting member 11 is bent, the distal ends of the teeth can adequately contact the surface of the scalp.

Figure 19:
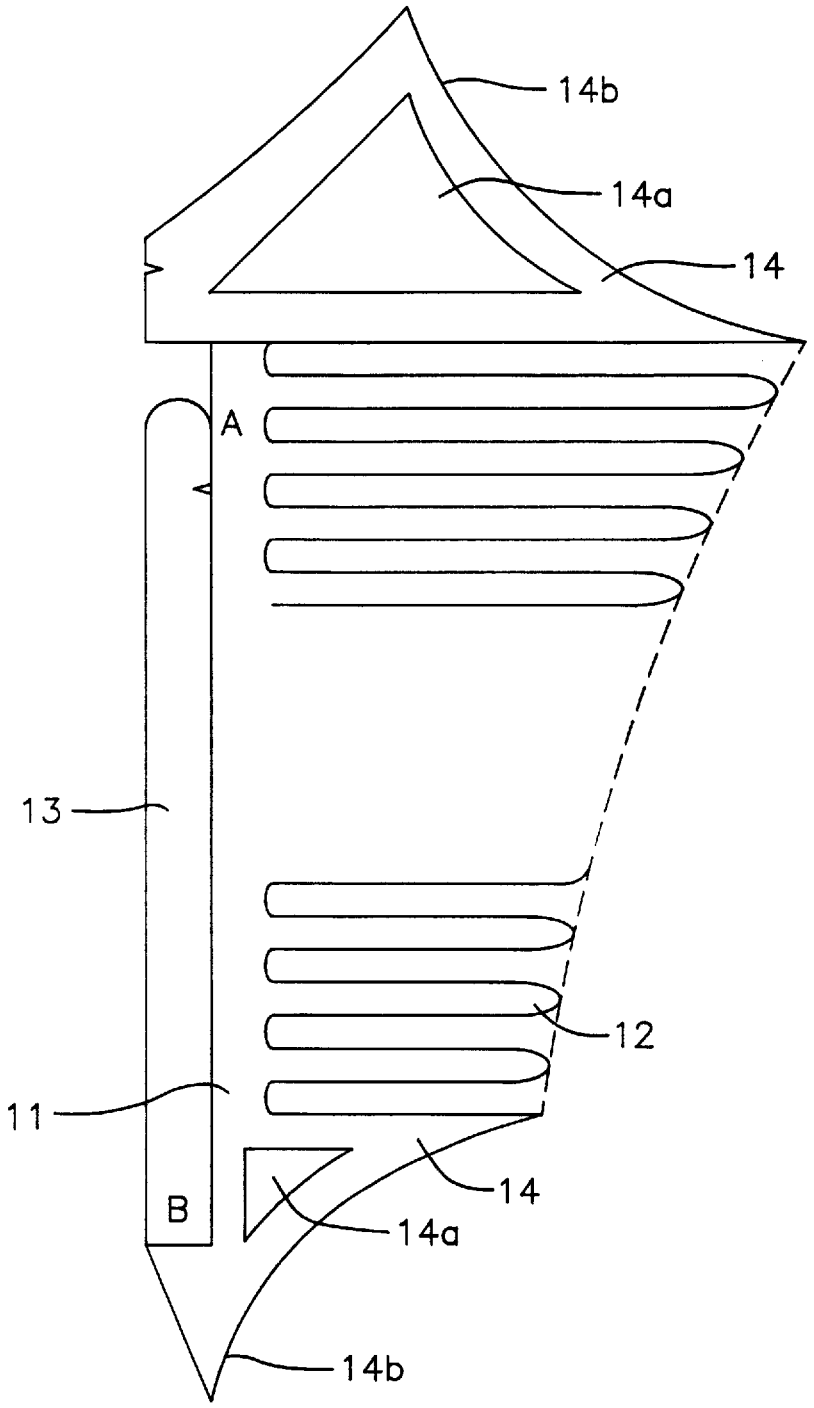
FIG. 19 is a plan view of a ninth comb.
Figure 20:
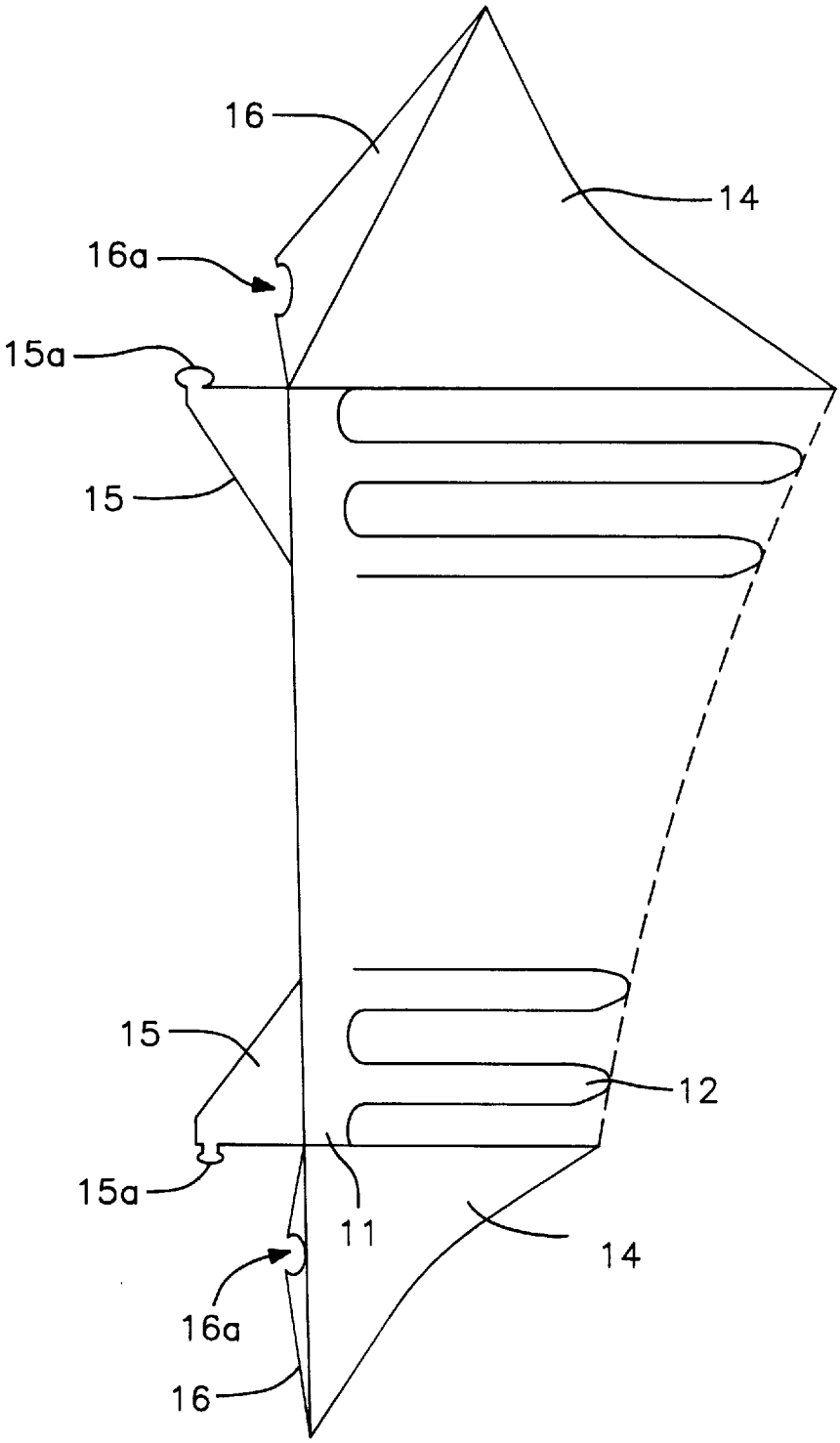
FIG. 20 is a plan view of a tenth comb.

Combs according to other embodiments will now be described while referring to FIGS. 18 through 20. FIG. 18 is a plan view of a comb (an eighth comb) according to another embodiment of the present invention; FIG. 19 is plan view of a comb (a ninth comb) according to an additional embodiment; and FIG. 20 is a plan view of a comb (a tenth comb) according to a further embodiment.

The eighth comb consists of a supporting member 11, a plurality of teeth 12 connected to the supporting member 11, and a band portion 13. The supporting member 11 and the teeth 12 are structured in the same manner as was explained while referring to FIGS. 16 and 17. In FIG. 18, however, the supporting member is formed linearly.

The band portion 13, which is the feature of the eighth comb, will be specifically explained.

The band portion 13 consists of a band main body 13*a* and a band fixing portion 13*b*. A notch (a first notch) 13*c* is formed in the band main body 13*a*, and a notch (a second notch) is also formed in the band fixing portion 13*b*.

Although the band main body 13*a* is connected to the supporting member 11 at the ends of the teeth 12, it is to be separated from the supporting member 11 from point A to point B. A portion from point A to point B may be separated in advance, or when notches are formed, a user of the eighth comb may separate that portion.

When the band main body 13*a* is separated from the supporting member 11 from point A to point B, the center of the comb is pulled to the front in the diagram, and the ends of the band portion 13 are pushed in the directions indicated by arrows. Then, the band main body 13*a* nears the band fixing portion 13*b* while the main body 13*a* is stretched, and the notch 13*c* in the band main body 13*a* and the notch 13*d* in the band fixing portion 13 are engaged and fixed in place. As a result, the eighth comb is formed three-dimensionally so that its maximum height measured from the scalp along the hairline is 18 mm or greater, and this shape is maintained by the action of the band portion 13. In this manner, the height of the eight comb can be determined by the positions of the notches 13*c* and 13*d*. In addition, when the locations of the point B and of the notch 13*d* are closer to the center of the supporting member 11, the band portion 13 determines the height of the comb from the scalp. Taking the curved shape of the scalp into consideration, a certain height is required.

In this embodiment, the lengths of all the teeth, except for those at either end, are adjusted so that they form a moderate arch, and the teeth at either end are so formed that they are extremely shorter that the other teeth. With this arrangement, when the supporting member 11 is bent, the distal ends of the teeth can contact the surface of the scalp by using the band main body 13*a* and the band fixing portion 13*b*.

The eighth comb is basically used to lift hair at the front of the head. A comb (a ninth comb) for lifting hair on the sides of the head will now be described while referring to FIG. 19. Specifically, the comb in FIG. 19 is used for the right side of the head.

The difference from the eighth comb in FIG. 18 is that side members 14 are provided at either side of a supporting member 11 and of teeth 12, as is shown in FIG. 19. The side members 14 have a triangular shape, and windows 14*a* are formed in their centers. These windows 14*a*, which reduce the weight of the comb, are not necessarily required.

In a band portion 13, which is attached to one side member (first side member) 14, a notch (a first notch) formed, and is separated from the supporting member 11 between point A and point B, as it is in FIG. 18. It should be noted that one part of the other side member (second side member) 14 is employed as the band fixing portion 13*b* and a notch (a second notch) is formed in this side member 14.

To shape the ninth comb three-dimensionally, the comb is bent substantially at a right angle at the junctures of the side members 14 and the teeth 12, and the notch in the band portion 13 engages and is fixed in the notch in the side member 14.

In FIG. 19, the length of teeth 12 increases gradually from one end to the other end of the comb. Specifically, since the lengths of the teeth are adjusted along the curve shown in FIG. 19, the distal ends of all the teeth can contact and conform to the surface of the scalp when the comb is bent at the junctures of the side members 14 and the supporting member 11, and sides 14*c* of the side members 14 contact the scalp.

Figure 21A:
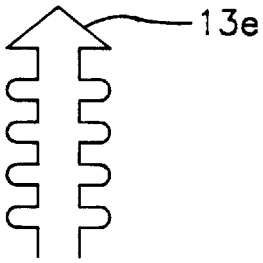
FIG. 21A–C are a diagram for explaining an engagement portion and en engagement fixing portion of the eighth and the ninth combs.
Figure 21B:
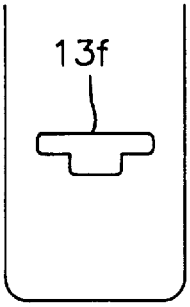
Figure 21C:
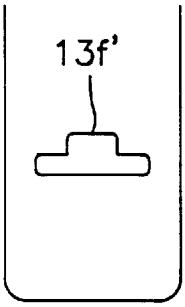
Figure 22A:
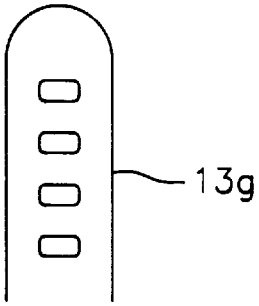
FIG. 22A–C are is a diagram for explaining the engagement portion and the engagement fixing portion of the eighth and the ninth combs.
Figure 22B:
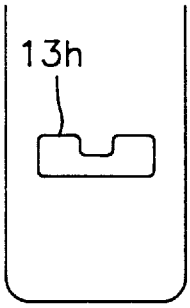
Figure 22C:
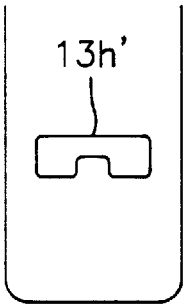

The structures for fixing the band portion 13 of the eighth or the ninth comb can be those shown in FIGS. 21 and 22. FIG. 21 is a diagram for explaining an engagement portion and an engagement fixing portion for the eighth and the ninth combs, and FIG. 22 is a diagram for explaining another engagement portion and another engagement fixing portion for the eighth and the ninth combs.

As is shown in FIG. 21, the distal end of the band portion 13 of the eight or the ninth comb is an engagement portion 13*e*having a plurality of protrusions on either side. Engagement fixing holes 13*f* and 13*f*' are formed in the corresponding band fixing portion 13*b*, or the side member 14, to hold the engagement portion 13*g*. The portions whereat the engagement fixing holes 13*f* and 13*f*' are located are called engagement fixing portions.

As is shown in FIG. 22, the distal end of the band portion 13 of the eight or the ninth comb is an engagement portion 13*g* having a plurality of protrusions on either side. Engagement fixing holds 13*h* and 13*h*' are formed in the corresponding band fixing portion 13*b*, or the side member 14, to hold the engagement portion 13*g*. The portion whereat the engagement fixing holes 13*h* and 13*g*' are located are called engagement fixing portions Broadly speaking, the notches in FIGS. 18 and 19 can be regarded as an engagement portion and an engagement fixing portion.

The tenth comb will now be described while referring to FIG. 20.

The tenth comb is basically employed in the same manner as is the ninth comb. The difference between it and the ninth comb is that a folding portion 15 is formed at either end of a supporting member 11 and an attached portion 16 is provided for one side of a side member 14. Further, a protruding portion 15*a* is provided as a connection portion for each folding portion 15, and a recessed portion 16*a* is provided as a connection portion for the attached portion 16. When the folding portions 15 and the side members 14 are folded backward in the diagram, the protruding portions 15*a* and the recessed portions 16*a* can contact each other (can engage and be fitted together).

Although, in the above example, the protruding portions are formed in the folding portion and the recessed portions are formed in the attached portions, recessed portions may be formed in the folding portions and protruding portions may be formed in the attached portions.

The protruding portions 15*a* are constricted at the portions where they are connected to the folding portions 15, and the inside of the recessed portions 16*a* are wide even though their openings in the attached portions 16 are narrow and constricted. The constricted portions of the protruding portions 15*a* and the recessed portions 16*a* prevent the folding portions 15 from being easily disengaged from the attached portions 16.

To form the tenth comb three-dimensionally, the folding portions 15 are folded backward in the diagram, the side members 14 are folded backward at the juncture with the teeth 12, and the protruding portions 15*a* of the folding portions 15 are securely fitted into the recessed portions 16*a* of the attached portions 16. In this fashion, the tenth comb is given a three-dimensional form, so that the maximum height measured from the scalp along the hairline is 18 mm or greater. This shape can be maintained by engaging the folding portions and the attached portions 16.

Figure 23:
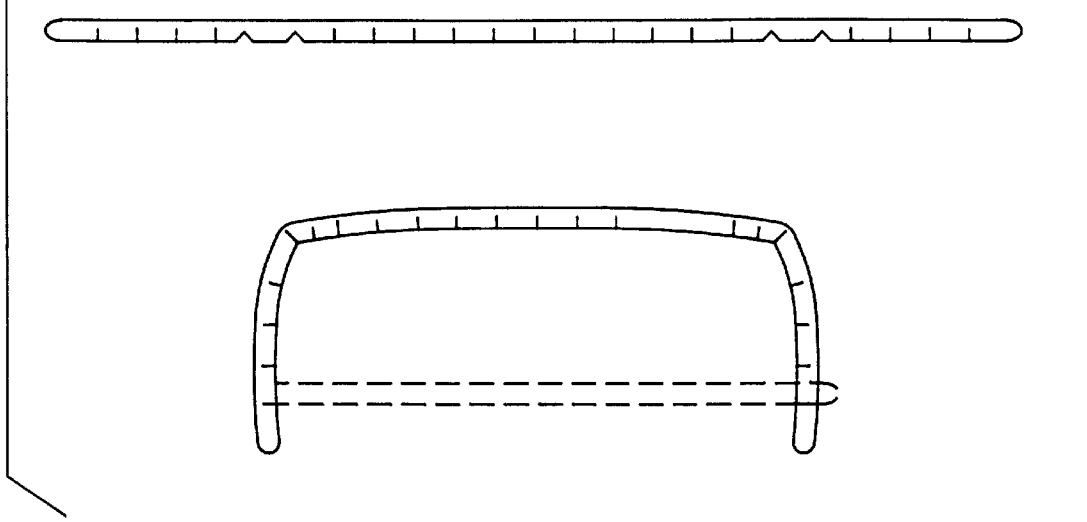
FIG. 23 is a schematic front view of the structure of an eleventh comb.

Combs (an eleventh and a twelfth comb) according to a still further embodiment of the present invention will now be described while referring to FIGS. 23 and 24. FIG. 23 is a schematic front view of the eleventh comb and FIG. 24 is a schematic front view of the twelfth comb.

While the combs in the previous embodiments are so designed that they are thin the eleventh and the twelfth combs are made of a material having a specific thickness so that they can be easily given three dimensional forms.

For the eleventh and the twelfth combs, a plurality of notches are formed in an inner face of a supporting member 11 when it is bent, and specifically, wide notches are formed at locations where the supporting member 11 is to be bent at an acute angle. As a result, the supporting member 11 can be easily bent in the shape that it is supposed to assume.

Figure 24:
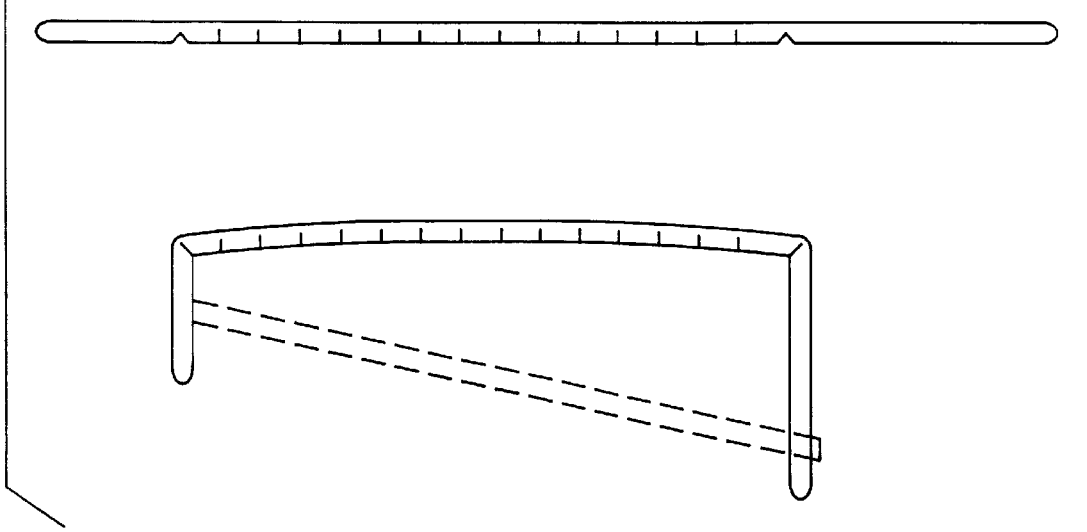
FIG. 24 is a schematic front view of the structure of a twelfth comb.

In FIG. 23 is shown the structure employed when the thick comb in FIG. 18 is to be bent into an assumed shape, and in FIG. 24 is shown the structure employed when the thick comb in FIG. 19 is to be bent into an assumed shape.

Figure 25A:
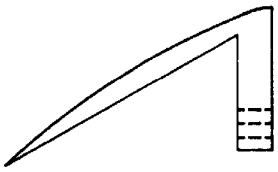
FIG. 25A–B are is a side view of a thirteenth comb.
Figure 25B:
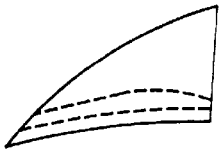

A thirteenth comb will now be described while referring to FIGS. 25A and 25B. FIGS. 25A and 25B are side views of the thirteenth comb.

As is shown in FIG. 25A, the thirteenth comb is so designed that perforated lines are provided in the supporting member 11 of the comb shown in FIG. 16 or 17 to arbitrarily adjust its height.

Further, as is shown in FIG. 25B, perforated lines are formed in the side member of the comb in FIG. 19 (no windows 14*a* are provided for the side members 14) or the comb in FIG. 20 to arbitrarily adjust its height.

Figure 26:
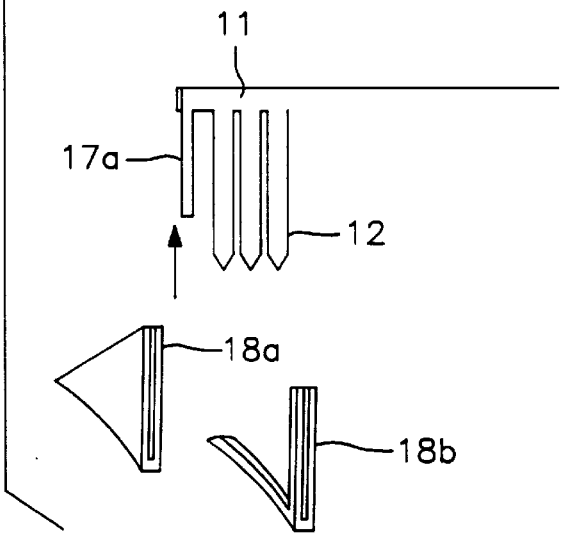
FIG. 26 is a side view of a fourteenth comb.

A fourteenth comb will now be described while referring to FIG. 26. FIG. 26 is a schematic diagram for explaining the fourteenth comb.

As is shown in FIG. 26, the fourteenth comb has attachment portions 17*a* at either end of a plurality of teeth 12 that are connected to a supporting member 11, and attachments 18*a* and 18*b* can be attached to the attachment portions 17*a*. In attachments 18*a* and 18*b* are grooves corresponding to the attachment portions 17*a*, so that the attachment portions 17*a* can be pushed into and fitted in the grooves.

The attachment portions 17*a* is a thin bar having a triangular prism or quadrangular prism shape, and extending in the same direction as the teeth 12.

The shape of the attachment 18*a* is almost the same as that of the side members 14 in FIG. 20, and a groove into which the bar-shaped attachment portion 17*a* is fitted is formed in one side of the attachment 18*a*.

The attachment 18*b* has a V shape, and is constituted by one side, in which a groove is formed corresponding to the bar-shaped attachment portion 17*a*, and the other side that is connected to that side and that contacts the surface When the attachments 18*a* and 18*b* are fitted over the attachment portion 17*a*, the fourteenth comb assumes a three-dimensional form, so that the maximum height measured from the scalp along the hairline is 18 mm or greater.

Figure 27:
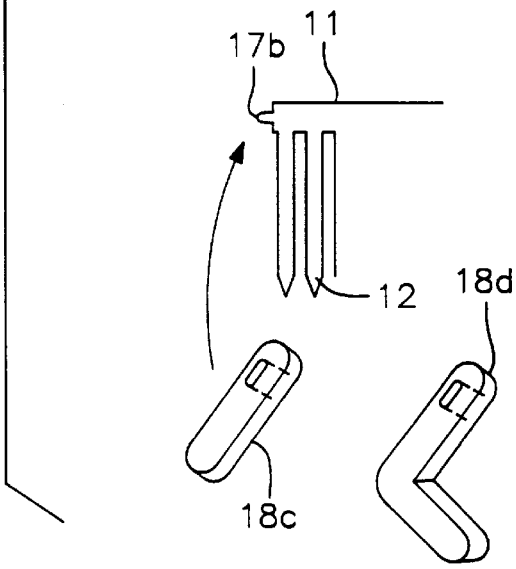
FIG. 27 is a side view of a fifteenth comb.

A fifteenth comb will now be described while referring to FIG. 27. FIG. 27 is a schematic diagram for explaining the fifteenth comb.

As is shown in FIG. 27, the fifteenth comb is so designed that attachment portions 17*b* are provided at either end of a plurality of teeth 12 that are connected to a supporting member, and attachments 18*c* and 18*d* are attached to the attachment portions 17. In the attachments 18*c* and 18*d* are holes corresponding to the attachment portions 17, so that the attachment portions 17*b* can be pushed into and fitted in the holes.

The attachment portions 17*b* protrude externally from the ends of the supporting member 11, and have a triangular prism, a quadrangular prism or an elliptical cylinder shape.

The attachments 18*c* are plates in which are holes into which the attachment portions 17*b* are fitted. Taking the contact with the scalp into consideration, the corners of the attachments 18*c* are rounded.

The attachments 18*d* are L-shaped plates in which are holes into which the attachment portions 17*b* are fitted. The corners of the attachments 18*d* are also rounded.

The fifteenth comb can thus be given a three-dimensional shape so that its maximum height measured from the scalp is 18 mm or greater along the hairline.

According to the embodiments of the present invention, the seventh through the fifteenth combs, for which the supporting member and the teeth 12 are normally formed flat, can be given a three-dimensional shape by folding the supporting member for the seventh comb, by fixing the supporting member 11 and the teeth 12 using the band portion 13 for the ninth comb, and by folding the folding portion 15 and engaging the protruding portions 15*a* in the recessed portions 16*a* for the tenth comb. As a result, the maximum height of these combs measured from the scalp is 18 mm or greater along the hairline. And for the eleventh and the twelfth combs, the supporting member 11 can be easily folded by forming notches in the supporting member 11. As for the thirteenth comb, its height can be arbitrarily changed by providing perforated lines for the supporting member 11 or the side members 14. As for the fourteenth and the fifteenth combs, the flat combs can be given a three-dimensional forms by arbitrarily connecting the attachments 18*a*, 18*b*, 18*c* and 18*d* to the attachment portions 17*a* and 17*b*, so that a comb's maximum height measured from the scalp along the hairline is 18 mm or greater.

According to the seventh hair lifting comb of the present invention, the supporting member can be folded so that the maximum height measured from the curved scalp is 18 mm or greater. As a result, a flat comb can be easily changed into a hair lifting comb.

According to the ninth collapsible hair lifting comb of the present invention, the side members are attached to the supporting member at either end of the teeth and the comb is bent at the juncture of the side members and the supporting member, so that the maximum height measured from the curved scalp is 18 mm or greater. Therefore, the flat comb can be easily changed into a hair lifting comb.

The seventh hair lifting comb of the present invention is so designed that a tooth at a specific position is wide and the supporting member can be folded so that the maximum height measured from the curved scalp is 18 mm or greater. Therefore, the flat comb can be easily changed into a hair lifting comb.

According to the seventh collapsible hair lifting comb of the present invention, space where no teeth are formed is provided at either side of the tooth located at a specific position, and the supporting member is so folded that the maximum height measured from the curved scalp is 18 mm or greater. As a result, the flat comb can easily be changed into a hair lifting comb.

According to the eighth collapsible hair lifting comb of the present invention, the first notch of the band potion can be inserted into and securely engage the second notch of the band fixing portion when the supporting member is folded to provide the maximum height of 18 mm or greater measured from the curved scalp. Thus, the flat comb can be easily changed into a hair lifting comb.

According to the ninth collapsible hair lifting comb of the present invention, the first and second side members are used to attain the maximum height of 18 mm or greater measured from the curved scalp, and when the side members are folded, the first notches of the band portion can be inserted into and securely engage the notches of the side members. As a result, the flat comb can be easily changed into a hair lifting comb.

According to the tenth collapsible hair lifting comb of the present invention, the side members are used to attain the maximum height of 18 mm or greater measured from the curved scalp, and when the side members and the folding portions are folded, the connection portions of the folding portions are securely fitted into the connection portions of the attached portions. Therefore, the flat comb can be easily changed into a hair lifting comb.

According to the eleventh and the twelfth collapsible hair lifting combs of the present invention, a plurality of notches area formed in the inner face of the supporting member that is bent, and a wide notch is specifically formed in an acutely bent portion. Therefor, the flat combs can be easily changed into hair lifting combs.

According to the thirteenth collapsible hair lifting comb of the present invention, since the perforated lines are provided for the supporting member to adjust the height, the flat comb can be easily changed into a hair lifting comb.

According to the thirteenth collapsible hair lifting comb of the present invention, since the perforated lines are provided for the side members to adjust the height, the flat comb can be easily changed into a hair lifting comb.

According to the fourteenth and the fifteenth collapsible hair lifting combs, since attachments are fitted over the attachment portions so that the maximum height measured from the curbed scalp is 18 mm or greater, the flat comb can be easily changed into a hair lifting comb.

According to yet another embodiment of the present invention, a hair lifting comb comprises teeth having a sufficient height to lift hair; a supporting member that is to be coupled to the teeth; and a heat generation member or a heat discharge member provided in the teeth and in the supporting member. When the heat generation member generates heat, or when the heat discharge member discharges heat, the comb is inserted, along the scalp from the hairline direction, into a portion of the front hair or the side hair that is to be lifted. The comb is removed when the heat generation member or the heat discharge member has cooled. In this manner, the hair can be arranged in an upswept hair style.

Figure 28:
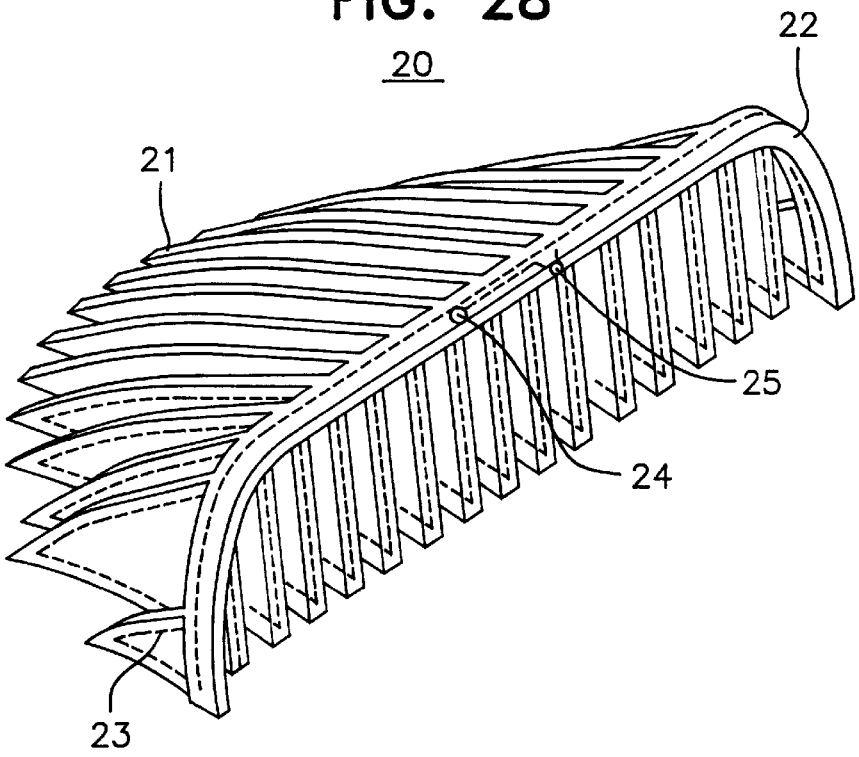
FIG. 28 is a diagram depicting the external appearance of a sixteenth comb.

A sixteenth hair lifting comb according to the embodiment will now be described while referring to FIGS. 28 and 29. FIG. 28 is a schematic diagram depicting the structure of the sixteenth example hair lifting comb (the sixteenth comb) according to the embodiment of the present invention, and FIG. 29 is a plan view for explaining the sixteenth comb.

Figure 29:
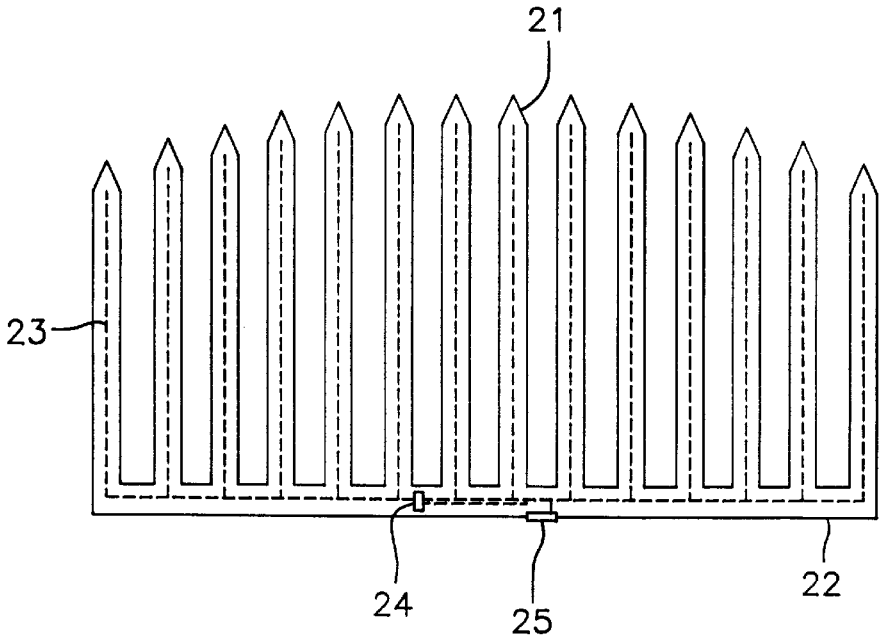
FIG. 29 is a plan view of the sixteenth comb.

As is shown in FIGS. 28 and 29, a sixteenth comb 20 has a plurality of teeth 21 and a supporting member 22 to which the teeth 21 are connected.

Although the teeth 21 are fixed to the supporting member 22 in parallel, assuming that a supporting member 22 is linear while the teeth 21 are maintained in parallel, the teeth 21 may be fixed perpendicularly or diagonally to the supporting member 22. Since the teeth 21 are fixed to the supporting member 22 while taking into consideration the angle at which hair is to be lifted, and since the supporting member 22 is a part for forming the line at the edge of which the front or the side hair is lifted, the supporting member 22 is curved, or formed linearly, not only vertically but also horizontally.

Further, among the teeth 21 is included at least one tooth that is long enough to provide the height of 18 mm or greater measured from the scalp. The teeth are tapered toward their distal ends, and are, in other words, triangularly shaped.

A heat generation member 23 is embedded in the teeth 21 and the supporting member 22. Further provided for the supporting member 22 are a thermostat 24, for maintaining the heat generation member 23 at an appropriate temperature when power is supplied to it, and a conductive terminal 25, for the electric connection with the heat generation member 23.

Owing to recent technical developments, the thermostat 24 is now small enough to be attached to the supporting member 22 of the comb.

Though not shown, the conductive terminal 25 can be connected to an attached socket. When the power plug for that socket is inserted into a home power outlet, power is supplied from the power source through the conductive terminal 25 to the heat generation member 23.

Upon the receipt of power from the home power source, the heat generation member 23 generates heat. The temperature of the heat generation member 23 is, however, controlled by the thermostat 24 so that it does not rise above a predetermined temperature. The predetermined temperature is a temperature that is high enough to lift hair.

The method for employing the sixteenth comb 20 will now be explained.

The power plug for the attached socket is inserted into a home power outlet, and the conductive terminal 25 is connected to the attached socket, so that the heat generation member 23 of the sixteenth comb 20 uses the home power source to generate heat.

When the thermostat 24 determines that the sixteenth comb 20 has attained a predetermined temperature, the power plug of the attached socket is extracted from the home power outlet, and the conductive terminal 25 of the sixteenth comb 20 is removed from the attached socket.

The sixteenth comb 20, at the predetermined temperature, is then inserted along the scalp, from the hairline of the front hair or the side hair to be lifted, toward the rear of the head until the roots of the teeth 21 reach the hairline. The hair between the teeth 21 are lifted the equivalent of the thickness of the teeth, and the hair that protrudes from the sixteenth comb 20 hangs down under its own weight to the shoulders.

When the heat generation member 23 cools, and the sixteenth comb 20 is accordingly cooled, the sixteenth comb 20 is removed from the hair. The hair that has been set by the heat discharged by the sixteenth comb 20 retains its shape when it is cooled. As a result, the hair is lifted up the equivalent of the thickness of the teeth 21. In this manner, the hair can be easily set in an upswept hair style.

Figure 30:
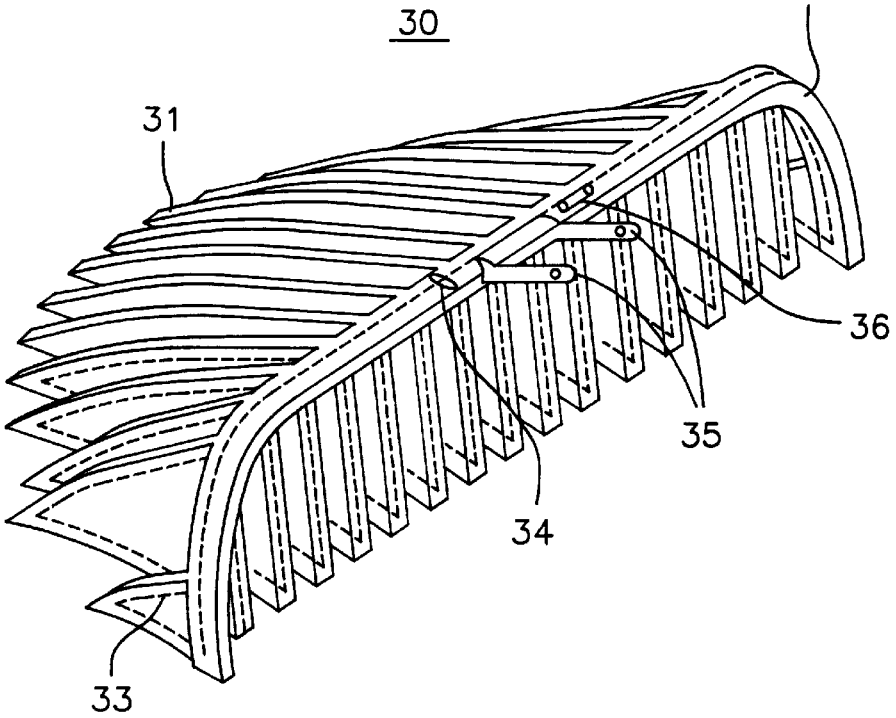
FIG. 30 is a diagram depicting the external appearance of a seventeenth comb.

A seventeenth hair lifting comb according to the embodiment of the present invention will now be described while referring to FIGS. 30 and 31. FIG. 30 is a schematic diagram depicting the seventeenth example of a hair lifting comb (a seventeenth comb) according to the embodiment of the present invention, and FIG. 31 is a plan view for explaining the seventeenth comb.

Figure 31:
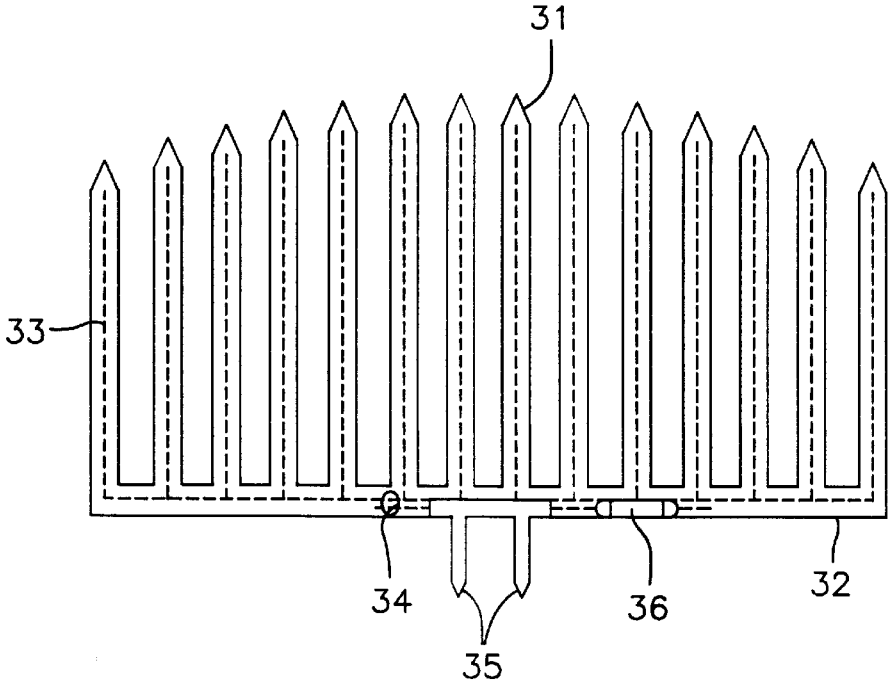
FIG. 31 is a plan view of the seventeenth comb.

As is shown in FIGS. 30 and 31, a seventeenth comb 30 has a plurality of teeth 31 and a supporting member 32 to which the teeth 31 are connected. As is the case with the sixteenth comb 20, a heat generation member 33 is embedded in the teeth 31 and the supporting member 32, and a thermostat 34 is attached to the supporting member 32.

In general, only the difference from the sixteenth comb 20 will be mainly explained.

For the seventeenth comb 30, instead of the conductive terminal 25 of the sixteenth comb 20, a power plug 35 is attached to the supporting member 32, and a fuse 36 is provided for the supporting member 32.

The power plug 35 can be directly inserted into a home power outlet, the fuse 36 being provided to prevent excessive power from being supplied from the home power outlet to the heat generation member 33.

The method for employing the seventeenth comb 30 is almost the same as that employed for the sixteenth comb 20, except that the power plug 35 of the seventeenth comb 30 is directly inserted into the home power outlet to obtain the power that the heat generation member 33 of the seventeenth comb 30 employs to generate heat.

Since the seventeenth comb 30 employs the power plug 35 to receive power directly from the home power outlet, to generate heat, the seventeenth comb 30 does not require the attached socket the sixteen comb 20 does.

Figure 32:
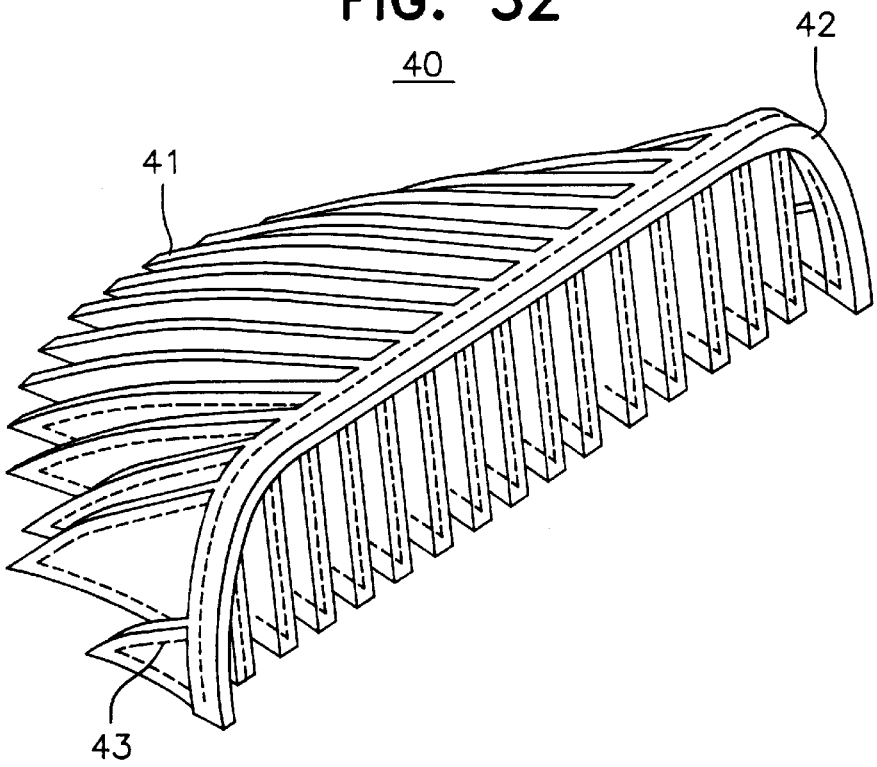
FIG. 32 is a diagram depicting the external appearance of an eighteenth comb.

An eighteenth example hair lifting comb according to the embodiment of the present invention will now be described while referring to FIGS. 32 and 33. FIG. 32 is a schematic diagram depicting the eighteenth hair lifting comb (the eighteenth comb) according to the present invention, and FIG. 33 is a plan view for explaining the eighteenth comb.

Figure 33:
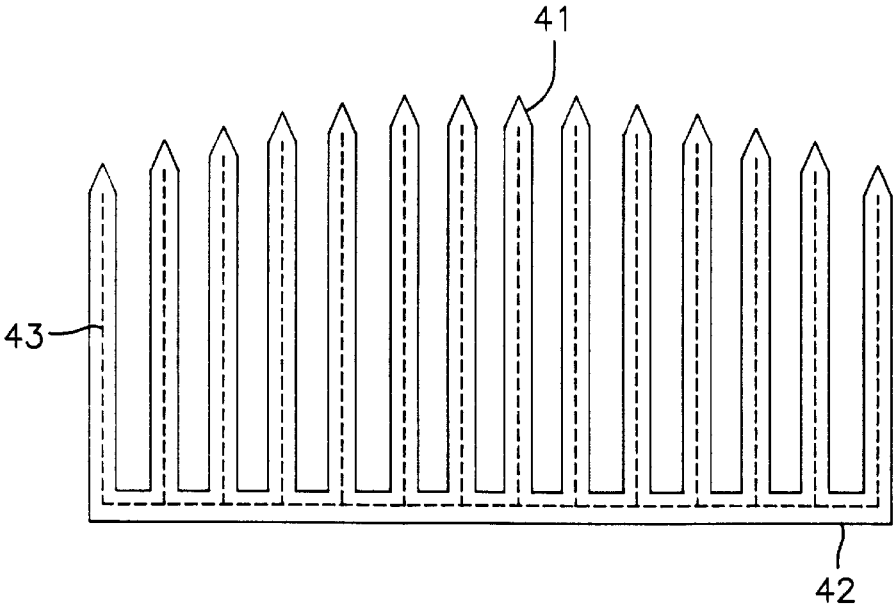
FIG. 33 is a plan view of the eighteenth comb.

As is shown in FIGS. 32 and 33, an eighteenth comb 40 has a plurality of teeth 41 and a supporting member 42 to which the teeth 41 are fixed. A heat discharge member 43 is embedded in the teeth 41 and the supporting member 42. The heat discharge member 43 may be embedded only in the teeth 41.

The heat discharge member 43 absorbs and accumulates external heat within a short period of time, and discharges heat gradually, e.g., in from five to ten minutes. The heat discharge member 43 is made of heat conductive material, the temperature of which is raised by external heat. The heat conductive material may be copper or another superior conductive metal, carbon, ceramics, or a superior conductive liquid or gas.

When the eighteenth comb 40 incorporating the heat generation member 43 is warmed by external heat, such as steam heat, and when the heat generation member 43 absorbs and accumulates the heat, the heat accumulated in the heat generation member 43 is gradually discharged to the hair, and the hair arrangement is set. When the eighteenth comb 40 has cooled, the hair is fixed in the lifted condition.

Figure 34:
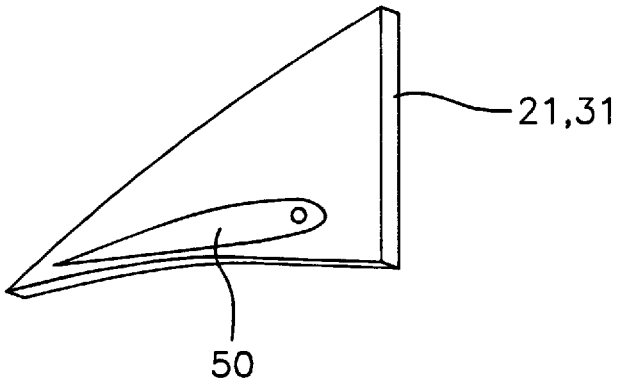
FIG. 34 is a schematic diagram illustrating a holder for a hair lifting comb according to the embodiment of the present invention.

Further, as is shown in FIG. 34, a holder 50 can be provided for the teeth at both ends of the sixteenth, the seventeenth and the eighteenth combs. FIG. 34 is a schematic diagram illustrating a holder 50 for the hair lifting comb according to the embodiment of the present invention.

The holder 50 is attached to the inner face or the outer face of the teeth at either end. In FIG. 34, the holder 50 is provided on the inner faces of the teeth. The holder 50 may be made either of metal or of plastic.

Figure 35:
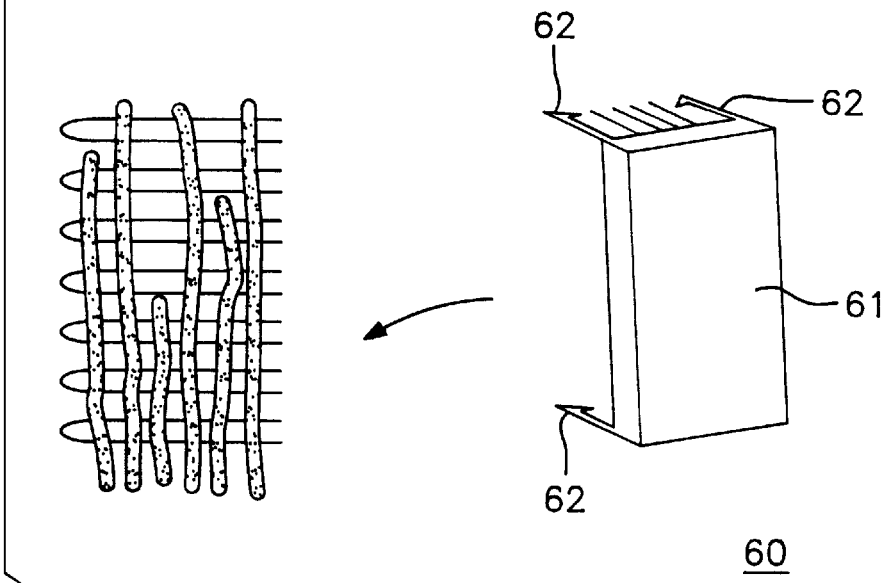
FIG. 35 is a schematic diagram illustrating another holder for a hair lifting comb according to the embodiment of the present invention.

Although the holder 50 having the simplest structure is shown in the example in FIG. 34, as is shown in FIG. 35 a holder 60 can be used for holding down a plurality of teeth from above. FIG. 35 is a schematic diagram showing the holder 60 for the hair lifting comb according to the embodiment of the present invention.

As is shown in FIG. 35, the holder 60 has legs 62 at the four corners of a flat plate 61. Engagement portions for securing the teeth are provided for the legs 62. When the engagement portions catch the teeth, the holder 60 is fixed to the teeth. Further, it is also possible for the teeth to be provided on the side of the flat plate 61 that crosses perpendicular to the direction in which hair grows, so that the teeth guide the hair.

According to the sixteenth and the seventeenth combs 20 and 30, the heat generation members 23 and 33 are embedded in the teeth 21 and 31 and the support members 22 and 32, and generate heat by using the power supplied via the conductive terminal 25 or the power plug 35. The warmed combs are then inserted into a portion of hair that is to be lifted, and the hair arrangement is set by the heat. Then, when the comb has cooled, it is removed from the hair. In this manner, the hair can be easily lifted.

According to the eighteenth comb 40, the heat discharge member 43 is embedded in the teeth 41 and the supporting member 42, and discharges the heat acquired from an external heat source, such as steam. When the warmed comb is inserted into a portion of hair that is to be lifted, the hair arrangement is set by the heat. Then, when the comb has cooled, it is removed from the hair. In this manner, the hair can be easily lifted.

In addition, since, unlike the sixteenth and the seventeenth combs 20 and 30, the eighteenth comb 40 does not require the conductive terminal 25 or the power plug 35, nor the thermostat 24 or 34, the manufacturing costs of the eighteenth comb 40 are lowered, and the weight of the comb 40 can be reduced, so that it will seldom fall from the hair.

According to the comb obtained by attaching holder 50 or 60 to the sixteenth or the seventeenth comb 20 or 30, since the weight of the comb is increased by providing the heat generation member 23 or 33, the thermostat 24 or 34 and the conductive terminal 25 or the power plug 35 that are embedded, the comb may fall when it is inserted into the hair. However, the holder 50 or 60 can prevent the comb from falling.

According to the comb obtained by attaching the holder 50 or 60 to the eighteenth comb 40, the holder 50 or 60 can prevent the comb from falling.

Since these combs include a heat generation function or a heat discharge function, with these combs hair can be easily lifted without requiring the application of hair lotion. Further, when hair lotion is applied to increase the setting strength, the human effort and time required for the setting are reduced because the drying of the hair using a hair dryer is not required.

In addition, for lifting hair along the hairline, the comb need only be inserted into a portion of hair to be lifted, without requiring the special skill needed for rolling hair with hot curlers or regular curlers. Thus, the comb of the present invention can be used easily by anyone.

Since conventional hair setting using curlers is merely a preliminary arrangement, and since the hair must be arranged using a brush after the curlers are removed, the arrangement of a hair style may succeed or fail depending on the occasion. However, since the hair lifting comb according to the embodiments have teeth having a calculated thickness, and the vertical and horizontal curve of the supporting member, a upswept hair style for the front hair or the side hair that is designed in advance, like a paper pattern for dress, can be set many times and almost provide the same appearance without requiring special skill.

According to the sixteenth hair lifting comb of the present invention, the heat generation member is located in the teeth and the supporting member and the conductive terminal and the thermostat is provided for the supporting member. When the heat generation member generates heat by using power supplied via the conductive terminal, and when the warmed comb is inserted into the portion of hair to be lifted, the hair arrangement is set by the heat, and the comb is removed after it has cooled. In this manner, the hair can be lifted easily.

According to the seventeenth hair lifting comb of the present invention, the heat generation member is located in the teeth and the supporting member, and the power plug, the thermostat and the fuse are provided on the supporting member. When the heat generation member generates heat by using power supplied via the power plug, and the warmed comb is inserted into the potion of hair that is to be lifted, the hair arrangement is set by the heat, and the comb is removed after it has cooled. In this manner, the hair can be lifted easily.

According to the eighteenth hair lifting comb of the present invention, since the heat discharge member for discharging heat provided by an external heat source is located in the teeth, the heat discharge member discharges heat acquired from an external heat source, such as steam, and when the warmed comb is inserted into the portion of hair to be lifted, the hair arrangement is set by the heat, and the comb is removed after it has cooled. In this manner, the hair can be lifted easily.

According to the sixteenth, the seventeenth and the eighteenth hair lifting combs, the teeth have a triangular shape, and at least one tooth has one side that is 18 mm or greater in the direction of the height. Therefore, in addition to the effects provided by the sixteenth, the seventeenth, and the eighteenth combs, the hair can be easily lifted from the scalp in the direction of the height.

Since the sixteenth, the seventeenth and the eighteenth combs of the present invention have hair holders for preventing the combs from falling from the hair, the falling from the hair of combs that incorporate the heat generation members can be prevented.

What is claimed is:

1. A hair lifting comb comprising:

a plurality of teeth;

a supporting member to which said plurality of teeth are attached; and side members for supporting said supporting member at a maximum height from a person's scalp of at least 18 mm, said supporting member being formed in a curved shape corresponding to a curvature of said scalp, said side member being developed on a concave side of the curved shape of said supporting member, said plurality of teeth extending rearwardly from a person's head from said supporting member when said supporting member is inserted along the hairline.

2. A hair lifting comb according to claim 1, wherein said supporting member is bar shaped, while said teeth that extend outward from said supporting member have the same thickness as said supporting member, and wherein distal ends of said teeth are bid beak shape.

3. A hair lifting comb according to claim 2, wherein said side members are triangularly shaped, and said triangular side members are hollow.

4. A hair lifting comb according to claim 3, further comprising:

a first frame member, formed toward said teeth and corresponding to one side of said triangularly shaped side member;

a second frame member, formed in the direction of the height of said supporting member and corresponding to one side of said triangularly shaped side member; and a third frame, formed along said scalp and corresponding to one side of said triangular shape of said side member.

5. A hair lifting comb according to claim 4, wherein said side member consists of only said second frame member and said third frame member.

6. A hair lifting comb according to claim 4, wherein said side member consists of only said first frame member and said third frame member.

7. A hair lifting comb according to claim 4, wherein said side member consists of only said second frame member.

8. A hair lifting comb comprising:

a plurality of teeth; and a supporting member to which said plurality of teeth are attached, said plurality of teeth extending rearwardly of a person's head from said supporting member when said supporting member is inserted along the hairline, and said supporting member being bent into a semicircular shape whose curvature is greater than the curvature of the scalp, with a maximum height from a person's scalp of at least 18 mm.

9. A collapsible hair lifting comb comprising:

a supporting member; and a plurality of teeth connected to said supporting member, whereof said teeth of said comb that are connected at an end of said supporting member are shorter than teeth that are connected at the central location of said supporting member, said teeth extending rearwardly from a person's head from said supporting member when said supporting member is inserted along the hairline, and whereof said supporting member is susceptible to be bent so that a maximum height from a person's curved scalp of at least 18 mm is attained.

10. A collapsible hair lifting comb comprising:

a supporting member; and a plurality of teeth connected to said supporting member, wherefor are provided side members that are attached to either end of said supporting member whereon said plurality of teeth are arranged, and wherefor said comb can be bent at junctures of said side members and said supporting member so that a maximum height from a person's curved scalp of at least 18 mm is attained, said plurality of teeth extending rearwardly from a person's head from said supporting member when said supporting member is inserted along the hairline.

11. A hair lifting comb comprising:

a plurality of teeth; and a supporting member to which said plurality of teeth are attached, said supporting member being bent into a semielliptical shape whose curvature is greater than the curvature of the scalp, with a maximum height from a person's scalp of at least 18 mm.

12. A hair lifting comb comprising:

a plurality of teeth, a supporting member to which said plurality of teeth are attached, and side members for supporting said supporting member at a maximum height from a person's scalp of at least 18 mm, said supporting member being bar shaped, while said teeth extend outwardly from said supporting member and have a same thickness as said supporting member, and distal ends of said teeth are bird beak shape, said side members being triangularly shaped, and said triangular side members being hollow.

13. A hair lifting comb according to claim 12, further comprising:

a first frame member, formed toward said teeth and corresponding to one side of said triangularly shaped side member;

a second frame member, formed in the direction of the height of said supporting member and corresponding to one side of said triangularly shaped side member; and a third frame, formed along said scalp and corresponding to one side of said triangular shape of said side member.

14. A hair lifting comb according to claim 13, wherein said side member consists of only said second frame member and said third frame member.

15. A hair lifting comb according to claim 13, wherein said side member consists of only said first frame member and said third frame member.

16. A hair lifting comb according to claim 13, wherein said side member consists of only said second frame member.

* * * * *